US006485345B1

(12) United States Patent
Fushimi

(10) Patent No.: US 6,485,345 B1
(45) Date of Patent: Nov. 26, 2002

(54) METHOD FOR MANUFACTURING ELECTRON BEAM APPARATUS SUPPORTING MEMBER AND ELECTRON BEAM APPARATUS

(75) Inventor: Masahiro Fushimi, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,266

(22) Filed: Feb. 24, 2000

(30) Foreign Application Priority Data

Feb. 25, 1999 (JP) ..... 11-048494
Feb. 23, 2000 (JP) ..... 2000-046351

(51) Int. Cl.[7] ..... H01J 9/24

(52) U.S. Cl. ..... 445/24

(58) Field of Search ..... 445/24; 313/422

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,682,085 A | | 10/1997 | Suzuki et al. | 315/169.1 |
| 5,721,050 A | * | 2/1998 | Roman et al. | 428/397 |
| 5,936,343 A | | 8/1999 | Fushimi et al. | 313/495 |

FOREIGN PATENT DOCUMENTS

| | | |
|---|---|---|
| EP | 0 394 698 | 10/1990 |
| JP | 57-118355 | 7/1982 |
| JP | 61-124031 | 6/1986 |
| JP | 64-31332 | 2/1989 |
| JP | 2-257551 | 10/1990 |
| JP | 3-55738 | 3/1991 |
| JP | 4-28137 | 1/1992 |
| WO | WO-94/ 18694 A1 * | 8/1994 |

OTHER PUBLICATIONS

R. Meyer, "Recent Development on "Microtips" Display at LETI", Technical Digest of IVMC 91, pp. 6–9 (1991).
M.I. Elinson, et al., "The Emission of Hot Electrons and the Field Emission of Electrons From Tin Oxide", Radio Engineering and Electronic Physics, No. 7, pp. 1290–1296 (Jul. 1965).
G. Dittmer, "Electrical Conduction and Electron Emission of Discontinuous Thin Films", Thin Solid Films, vol. 9, pp. 317–328 (1972).
M. Hartwell, et al., "Strong Electron Emission From Patterned Tin–Idium Oxide Thin Films", International Electron Devices Meeting, pp. 519–521 (1975).
H. Araki, et al., "Electroforming and Electron Emission of Carbon Thin Films", Journal of the Vacuum Society of Japan, vol. 26, No. 1, pp. 22–29 (Jan. 26, 1983).
W.P. Dyke, et al., "Field Emission", Advances in Electronics and Electron Physics, vol. VIII, pp. 89–185 (1956).
C.A. Spindt, et al., "Physical Properties of Thin–Film Field Emission Cathodes With Molybdenum Cones", Journal of Applied Physics, vol. 47, No. 12, pp. 5248–5263 (Dec. 1976).
C.A. Mead, "Operation of Tunnell–Emission Devices", Journal of Applied Physics, vol. 32, No. 4, pp. 646–652 (Apr. 1961).

* cited by examiner

*Primary Examiner*—Kenneth J. Ramsey
(74) *Attorney, Agent, or Firm*—Fitzpatrick, Cella, Harper & Scinto

(57) ABSTRACT

A method of manufacturing a supporting member for an electron beam apparatus including an airtight container, an electron source and the supporting member arranged in the airtight container, includes a step of heating and drawing a substrate of the supporting member. An electroconductive film is formed on a surface of the substrate in the heating and drawing step.

28 Claims, 16 Drawing Sheets

METHOD FOR MANUFACTURING ELECTRON BEAM APPARATUS SUPPORTING MEMBER AND ELECTRON BEAM APPARATUS

BACKGROUND OF THE INVENTION

1. Field of the Invention

The present invention relates to a method for manufacturing an electron beam apparatus supporting member arranged in an airtight container in an electron beam apparatus having the airtight container in which an electronic source is contained, an electron beam apparatus supporting member manufactured by using the method, and an electron beam apparatus such as an image-forming apparatus having the electron beam apparatus supporting member.

2. Related Background Art

Conventionally there are known two types of electron-emitting devices; a hot-cathode device and a cold-cathode device. As the cold-cathode device among these, there are known a surface conduction electron-emitting device, a field emission device (hereinafter also referred to as an FE device), and a metal-insulator-metal emission device (hereinafter also referred to as an MIM device), for example.

The surface conduction electron-emitting device utilizes a phenomenon that electrons are emitted by flowing current on a thin film having a small area formed on a substrate, so as to be in parallel with its film surface. As the surface conduction electron-emitting device, there are known one with an $SnO_2$ thin film [M. I. Elinson, Radio Eng. Electron Phys., 10, 1290, (1965)], one with an Au thin film [G. Dittmer: "Thin Solid Films," 9, 317 (1972)], one with $In_2O_3/SnO_2$ thin film [M. Hartwell and C. G. Fonstad: "IEEE Trans. ED Conf.," 519 (1975)], and one with a carbon thin film [Hisashi Araki et al.: "Vacuum," vol. 26, No. 1, 22 (1983)], for example.

As a typical example of a device configuration of these surface conduction electron-emitting devices, FIG. 15 shows a plan view of a surface conduction electron-emitting device with an $In_2O_3/SnO_2$ thin film to M. Hartwell et al. as set forth in the above. In the surface conduction electron-emitting device with an $In_2O_3/SnO_2$ thin film, an electroconductive thin film 904 made of metallic oxide is formed in a sputtering process on a surface of an insulating substrate 901 as shown in FIG. 15. The electroconductive thin film 904 is formed in an H-shaped plane as shown in FIG. 15. The electroconductive thin film 904 is subjected to an energization operation called energization forming described later, by which an electron-emitting region 905 is formed in a central portion of the electroconductive thin film 904. A gap L shown in FIG. 15 is set to 0.5 to 1 mm and a width W of a region where there is formed the electron-emitting region 905 of the electroconductive thin film 904 is set to 0.1 mm. While the electron-emitting region 905 is represented by a rectangle in the center of the electroconductive thin film 904 in FIG. 15, a position and a shape of the electron-emitting region 905 are typical ones and they do not represent a position and a shape of an actual electron-emitting region 905 faithfully.

Giving an example of FIG. 15 for a description in the above surface conduction electron-emitting devices including the device to M. Hartwell, generally the electroconductive thin film 904 is subjected to an energization operation called energization forming before an electron emission, by which the electron-emitting region 905 is formed on the electroconductive thin film 904. The energization forming means that a constant dc voltage or a dc voltage increasing at a very slow rate of approx. 1 V/min or so, for example, is applied at both ends of the electroconductive thin film 904 for energizing in order to destruct, deform, or change in quality the electroconductive thin film 904 locally to form the electron-emitting region 905 having an electrically high resistance on the electroconductive thin film 904. At this point, a fissure is generated in a part of the electroconductive thin film 904 locally destructed, deformed, or changed in quality. If a voltage is appropriately applied to the electroconductive thin film 904 after the above energization forming, an electron emission occurs in the vicinity of the fissure generated in the electroconductive thin film 904.

In addition, as FE devices, there are known one described in "Field emission," Advance in Electron Physics, 8, 89 (1956) to W. P. Dyke & W. W. Dolan et al. or one described in "Physical properties of thin-film field emission cathodes with molybdenium cones," J. Appl. Phys., 47, 5248 (1976) to C. A. Spindt et al.

As a typical example of the FE devices, FIG. 16 shows a sectional view of a device to C. A. Spindt et al. as set forth in the above. In a conventional FE device, as shown in FIG. 16, emitter wiring 961 made of electroconductive materials is formed on a substrate 960 as shown in FIG. 16. On the surface of the emitter wiring 961, an emitter cone 962 and an insulating layer 963 are formed, respectively, and a gate electrode 964 is formed on a surface of the insulating layer 963. This FE device emits an electric field from a tip portion of the emitter cone 962 by applying a voltage appropriately to a portion between the emitter cone 962 and the gate electrode 964.

As another configuration of the FE device, there is a structure in which an emitter and a gate electrode are arranged on a substrate almost in parallel with a surface of the substrate instead of the laminated structure as shown in FIG. 16.

As an MIM device, there is known one described in C. A. Mead, "Operation of tunnel-emission Devices," J. Appl. Phys., 32, 646 (1961), for example. Referring to FIG. 17, there is shown a sectional view showing a typical example of the MIM device. In a conventional MIN device, as shown in FIG. 17, a lower electrode 971 made of a metal is formed on the substrate 970. On a surface of the lower electrode 971, a thin insulating layer 972 having a thickness of approx. 100 angstroms is formed on a surface of the lower electrode 971 and an upper electrode 973 made of a metal having a thickness of approx. 80 to 300 angstroms on a surface of the insulating layer 972. In this type of the MIM device, a voltage is appropriately applied to a portion between the upper electrode 973 and the lower electrode 971, by which electrons are emitted from a surface of the upper electrode 973.

The above cold-cathode device is capable of achieving an electron emission at a lower temperature in comparison with the hot-cathode device, and therefore it does not need a thermal heater. Accordingly, the cold-cathode device has a configuration simpler than that of the hot-cathode device, by which it can be manufactured as a fine device. Additionally even if a lot of cold-cathode devices are arranged at a high density on the substrate, it does not easily have a problem such as heat fusion on the substrate. Furthermore, the cold-cathode device has an advantage of a rapid response contrary to the hot-cathode device whose response speed is relatively low since it is operated by heating with the heater.

Accordingly, research on applications of the cold-cathode device has been actively performed.

For example, the surface conduction electron-emitting device has a particularly simple configuration among cold-cathode devices and is easy to manufacture, thus having an advantage that a lot of devices can be formed over a large area. Therefore, as disclosed in Japanese Patent Application Laid-Open No. 64-31332 to this applicant, for example, research has been done on a method for driving with arranging a lot of surface conduction electron-emitting devices. As for an application of an electron beam apparatus using this type of a surface conduction electron-emitting device, research has been done on image-forming apparatuses such as an image display and an image recording apparatus and charging beam sources, for example.

Particularly as an application of an electron beam apparatus to an image display, as disclosed in specifications of U.S. Pat. No. 5,066,883 to this applicant, Japanese Patent Application Laid-Open No. 2-257551, and Japanese Patent Application Laid-Open No. 4-28137, for example, research has been done on an image display using a surface conduction electron-emitting device combined with phosphor which emits light by means of irradiation of an electron beam from the surface conduction electron-emitting device. The image display using the surface conduction electron-emitting device combined with the phosphor is expected to have characteristics superior to those of other types of conventional image displays. Accordingly, the image display to which the electron beam apparatus is applied is superior in that it does not need a back light since it is of a self light emission type and in that it has a wide view angle, in comparison with liquid crystal display units which have been spreading in recent years, for example.

A method for driving with arranging a lot of FE type devices is disclosed in specifications of U.S. Pat. No. 4,904,895 to this applicant, for example. In addition, as an example of an application of an FE type device to an image display, there is known a flat panel display suggested by R. Meyer et al. [R. Meyer: "Recent Development on Micro-tips Display at LETI," Tech. Digest of 4th Int. Vacuum Microelectronics Conf., Nagahama, pp. 6 to 9 (1991)], for example.

Furthermore, as an example of an application of a lot of arranged MIM-type devices to an image display, there is an image display disclosed in Japanese Unexamined Patent No. 3-55738 to this applicant, for example.

A flat panel display having a short depth is space-saving and light in weight among the above image-forming apparatuses to which the above electron beam apparatus having the electron-emitting device is applied, thereby drawing public attention as a display superseding a CRT display.

Referring to FIG. 18, there is shown a perspective view showing an example of a display panel portion in a conventional flat panel display to which the electron beam apparatus is applied, in which a part of the panel is illustrated in a cutaway view to show an internal structure of the display panel portion.

In the display panel portion in the conventional flat panel display, a substrate 911 is mounted on a surface of a rear plate 915 as shown in FIG. 18. A sidewall 916 is bonded to an edge portion of the surface of the rear plate 915 therealong. A face plate 917 opposite to the rear plate 915 is bonded to a surface of the sidewall 916 opposed to the rear plate 915. The face plate 917, the sidewall 916, and the rear plate 915 form an airtight container (envelope) 931 of the display panel sealed to keep an inside of the display panel in a vacuum, with the face plate 917, the sidewall 916, and the rear plate 915 each forming a wall portion of the sealed container 931.

On the substrate 911 fixed to the rear plate 915, cold-cathode devices 912 are formed in a matrix by N×M. N and M are positive integers equal to or greater than 2 and values of N and M are appropriately set according to the target number of pixels of a display. The N×M of cold-cathode devices 912 are coupled to each other with row-directional wiring 913 of M wires and column-directional wiring 914 of N wires as shown in FIG. 18. A multiple electron beam source 932 comprises the substrate 911, the cold-cathode devices 912, the row-directional wiring 913, and the column-directional wiring 914 in the above. In an at least intersecting portion of the row-directional wiring 913 and the column-directional wiring 914, an insulating layer (not shown) is formed therebetween, so that the row-directional wiring 913 is kept to be electrically insulated from the column-directional wiring 914 in the intersecting portion.

A phosphor film 918 made of phosphor is formed on a lower surface of the face plate 917 in the rear plate 915 side, and the phosphor film 918 is made of phosphor materials having three primary colors; red (R), green (G), and blue (B) (not shown). In addition, a black material (not shown) is formed between the above colored phosphor materials forming the phosphor film 918 and a metal back 919 made of Al or the like is formed on a surface of the phosphor film 918 in the rear plate 915 side. This metal back 919 is used as a control electrode for controlling electrons emitted from the cold-cathode device 912, and an accelerating voltage for affecting the electrons is applied to those so as to accelerate the electrons emitted from the cold-cathode devices 912.

On the sidewall 916, terminals Dx1 to Dxm, Dy1 to Dyn, and Hv for electrical connections in the airtight structure are mounted to connect electrically the row-directional wiring 913, the column-directional wiring 914, and the metal back 919 of the display panel to an electrical circuit which is not shown in an outside of the display panel. These terminals are protruding from the sidewall 916 to an outside of the airtight container 931. The terminals Dx1 to Dxm are electrically connected to the row-directional wiring 913 corresponding to the terminals Dx1 to Dxm, respectively, the terminals Dy1 to Dyn are electrically connected to the column-directional wiring 914 corresponding to the terminals Dx1 to Dxm, respectively, and the terminal Hv is electrically connected to the metal back 919.

The inside of the airtight container 931 is maintained in a vacuum of approx. $10^{-6}$ Torr, and therefore, as a display area of the image display becomes larger, there occurs a need for means of preventing the rear plate 915 and the face plate 917 from being deformed or destroyed due to a difference between atmospheric pressures of the inside and the outside of the airtight container 931. In using a method of increasing a thickness of the rear plate 915 and of the face plate 917 to prevent them from being deformed or destroyed, not only a weight of the image display is increased, but a distortion or a parallax error occurs when a display surface is viewed in an oblique direction. On the other hand, as shown in FIG. 18, there are provided spacers (also referred to as ribs) 920 as electron beam apparatus supporting members each made of a relatively thin glass plate for bearing an atmospheric pressure between the substrate 911 and the face plate 917. The rear plate 915 and the face plate 917 are supported by the spacers 920, by which a submillimeter to several millimeters of a gap is normally maintained between the substrate 911 composing a multiple electron beam source 932 and the face plate 917 on which the phosphor film 918 is formed and an inside of the airtight container 931 is kept in a high vacuum as described above.

When a voltage is applied to the cold-cathode devices 912 through the terminals Dx1 to Dxm and Dy1 to Dyn protruding outside the airtight container 931 in the image display having the above-described display panel, electrons are emitted from the respective cold-cathode devices 912. Simultaneously with it, a high voltage of hundreds of volts to thousands of volts is applied to the metal back 919 through the terminal Hv to accelerate electrons emitted from the cold-cathode devices 912 so that the accelerated electrons collide with an inner surface of the face plate 917. This excites phosphor materials having respective colors composing the phosphor film 918, by which they emit lights to display an image on a display screen on the display panel.

On the display panel shown in FIG. 18, a part of electrons emitted from the cold-cathode devices 912 in the vicinity of the spacers 920 collide with the spacers 920 or ions ionized due to an effect of the emitted electrons adhere to the spacers 920, by which static electrification may occur on the spacers 920. If this static electrification occurs on the spacers 920, a trajectory of the electrons emitted from the cold-cathode devices 912 is excessively curved and the electrons having the excessively curved trajectory reach positions different from normal positions on the phosphor of the phosphor film 918, by which an image in the vicinity of the spacers 920 is distorted on the display disadvantageously.

If any of the spacers 920 moves off the original position due to an assembly error of the display panel at this point, a distance between the spacer 920 and the cold-cathode device 912 partially narrows and the difference of the electron trajectory is significantly increased. In this manner, the distortion of the image on the display screen is further extended by a positional difference of the spacer 920, too.

In addition, a high voltage of hundreds of volts, in other words, 1 kV/mm or higher electric field is applied to a portion between the multiple electron beam source 932 and the face plate 917 to accelerate the electrons emitted from the cold-cathode devices 912, by which a creeping discharge may occur on a surface of the spacer 920. Particularly if the spacers 920 are charged as described above, discharging may be caused by the high voltage.

If any of the spacers 920 moves off the original position due to an assembly error of the display panel at this point, the distance between the spacer 920 and the cold-cathode device 912 partially narrows, too, which increases a probability of giving an extended damage on the cold-cathode devices 912 at discharging caused by static electrification of the spacers 920, thus accelerating a deterioration of the cold-cathode devices 912 disadvantageously.

To solve these problems, there have been suggested methods for removing static electrification of the spacers 920 by flowing microcurrent through the spacers 920 in Japanese Patent Application Laid-Open No. 57-118355 and Japanese Patent Application Laid-Open No. 61-124031. In these methods in the official gazettes, a high resistance thin film is formed as an antistatic film on a surface of an insulating spacer substrate and is formed as a spacer comprising spacer electrodes put on the upper and lower surfaces of the spacer substrate, so that microcurrent flows uniformly over the surfaces of the spacer through the spacer electrodes. As for materials of the antistatic film, a tin oxide film, a mixed crystal thin film made of tin oxide and indium oxide, or a metal film is used.

Referring to FIG. 19, there is shown a flowchart for explaining a spacer manufacturing process according to a conventional technology. In the conventional spacer manufacturing process, a substrate is made first to form a spacer substrate by molding a base material made of the same component material as for the spacer substrate having a larger shape than one for the spacer substrate composing the spacer (S11). Second, by cutting the substrate (S12), the spacer substrate is cut off from the substrate to manufacture the spacer substrate. Next, a high resistance film is formed on a surface of the spacer substrate as an antistatic film (S12), and further spacer electrodes are partially formed on the spacer substrate on which the high resistance film is formed (S14), by which a spacer is manufactured having the high resistance film and the spacer electrodes formed on the spacer substrate.

There is such a problem, however, in forming a high resistance film or spacer electrodes on an insulating spacer substrate when manufacturing a spacer which is an electron beam apparatus supporting member that the number of processes is increased or a manufacturing process is complicated, which leads to an increase of a manufacturing time or of a manufacturing cost, thereby easily deteriorating a mass production property.

SUMMARY OF THE INVENTION

Therefore it is an object of the present invention to provide a method of manufacturing a supporting member for an electron beam apparatus free from unevenness in a shape or characteristics in a small number of simplified processes.

It is another object of the present invention to provide a method of manufacturing a supporting member for an electron beam apparatus in which the electron beam apparatus supporting member can be manufactured in a small number of simplified processes in a short manufacturing time at a low manufacturing cost so as to have a mass production property, a supporting member for an electron beam apparatus manufactured by using the method, and an electron beam apparatus having the electron beam apparatus supporting member.

According to one aspect, the present invention relates to a method of manufacturing a supporting member for an electron beam apparatus comprising an airtight container and an electron source and the supporting member arranged in the airtight container, including a step of heating and drawing a substrate of the supporting member, wherein an electroconductive film is formed on a surface of the substrate in the heating and drawing step.

According to another aspect, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a formation member for forming the insulating member by molding with heating a base material comprising a component of the insulating member and forming at least one of the high resistance film and the electrode or a precursor of at least one of the high resistance film and the electrode on the formation member in a process in which the formation member cools down from a temperature at which the base material is heated to be molded.

According to still another aspect, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a formation member for forming the insulating member by molding with heating a base material comprising a component of the insulating member, forming at least one of the high resistance film and the electrode on the formation member in a process in which the formation member cools down from a temperature at which the base material is heated to be molded, forming the other among the high resistance film and the electrode on the formation member in a process in which the formation member cools down from a temperature at which one of the high resistance film and the electrode is formed on the formation member, and manufacturing the electron beam apparatus supporting member by cutting the formation in which the high resistance film and the electrode are formed on the formation member.

According to a further aspect, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a cylindrical formation member for forming the insulating member by molding with heating a base material comprising a component of the insulating member, forming the high resistance film on sidewalls of the formation member in a process in which the formation member cools down from a temperature at which the base material is heated to be molded, cutting the formation in which the high resistance film is formed on the formation member at a predetermined length to make the high resistance film formed on the insulating member, and forming the electrode on a cut surface of the insulating member and of the high resistance film.

According to a still further aspect, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of heating a base material comprising a component of the insulating member, forming a sheet formation member for forming the insulating member by pushing the heated base material for compression so that the base material has a predetermined thickness, forming the precursor of the high resistance film on face and rear surfaces of the sheet formation member in a process in which the sheet formation member cools down from a temperature at which the base material is compressed, forming the high resistance film on the face and rear surfaces of the sheet formation member by calcining the precursor of the high resistance film formed on the face and rear surfaces of the sheet formation member, cutting the high resistance film formed on the sheet formation member to make the high resistance film formed on the insulating member comprising the cut portion of the sheet formation member, and forming the electrode on a cut surface of the insulating member and of the high resistance film.

DETAILED DESCRIPTION OF THE PREFERRED EMBODIMENTS

Figure 1:
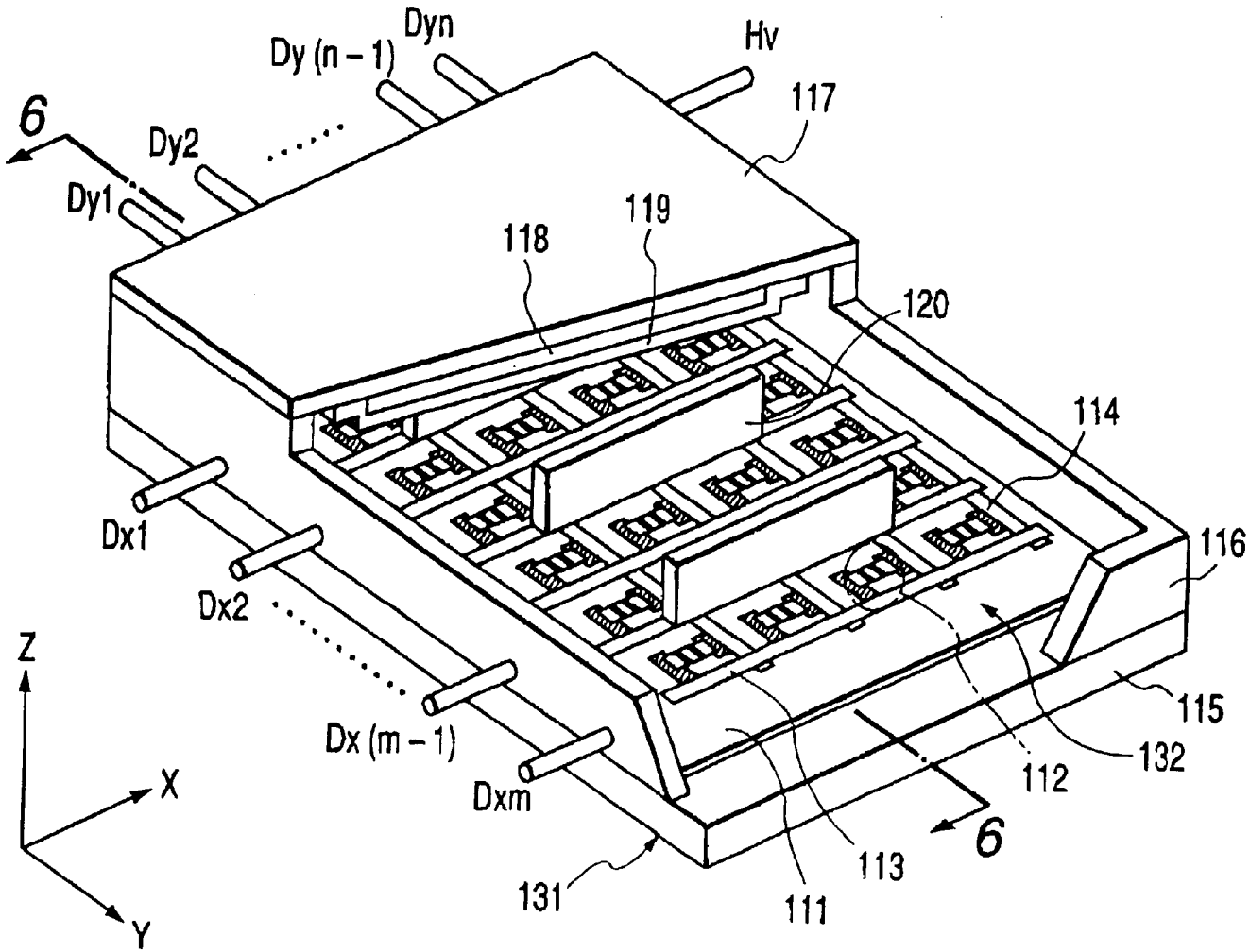
FIG. 1 is a perspective diagram of a display panel of an image display of an embodiment according to the present invention.

The present invention relates to a method of manufacturing a supporting member for an electron beam apparatus comprising an airtight container, an electron source and the supporting member arranged in the airtight container, including a step of heating and drawing a substrate of the supporting member, wherein an electroconductive film is formed on a surface of the substrate in the heating and drawing step.

In addition, the method of manufacturing a supporting member for an electron beam apparatus is characterized by the electroconductive film formation including a step of coating the substrate with a solution including a component of the electroconductive film in the heating and drawing step.

Further, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a formation member for forming the insulating member by molding with heating a base material comprising a component of the insulating member and forming at least one of the high resistance film and the electrode or a precursor of at least one of the high resistance film and the electrode on the formation member in a process in which the formation member cools down from a temperature at which the base material is heated to be molded.

The invention relates to a method of manufacturing a supporting member for an electron beam apparatus further comprising a step of manufacturing the supporting member for the electron beam apparatus in which at least one of the high resistance film and the electrode is formed on the insulating member comprising a cut portion of the formation member by cutting a formation in which at least one of the high resistance film and the electrode is formed on the formation member.

The invention relates to a method of manufacturing a supporting member for an electron beam apparatus, wherein the precursor is formed by coating the formation member with a solution in which at least one component of the high resistance film and the electrode is dispersed to a solvent and vaporizing the solvent by utilizing heat of the formation member so as to fix solute in the solution to the formation member when the precursor of at least one of the high resistance film and the electrode is formed on the formation member. In this condition, the method of manufacturing a supporting member for an electron beam apparatus further comprising the steps of forming at least one of the high resistance film and the electrode on the formation member by calcining the precursor and manufacturing the supporting member for the electron beam apparatus in which at least one of the high resistance film and the electrode is formed on the insulating member comprising a cut portion of the formation member by cutting a formation in which at least one of the high resistance film and the electrode is formed on the formation member.

Still further, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a formation member for forming the insulating member by molding with heating a base material comprising a component of the insulating member, forming at least one of the high resistance film and the electrode on the formation member in a process in which the formation member cools down from a temperature at which the base material is heated to be molded, forming the other among the high resistance film and the electrode on the formation member in a process in which the formation member cools down from a temperature at which one of the high resistance film and the electrode is formed on the formation member, and manufacturing the supporting member for the electron beam apparatus by cutting the formation in which the high resistance film and the electrode are formed on the formation member.

Furthermore, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of forming a cylindrical formation member for forming the insulating member by molding with heating a base material comprising a component of the insulating member, forming the high resistance film on sidewalls of the formation member in a process in which the formation member cools down from a temperature at which the base material is heated to be molded, cutting the formation in which the high resistance film is formed on the formation member at a predetermined length to make the high resistance film formed on the insulating member, and forming the electrode on a cut surface of the insulating member and of the high resistance film.

According to a method of manufacturing a supporting member for an electron beam apparatus, it is preferable that the step of forming the formation member for forming the insulating member of the electron beam apparatus supporting member comprises the steps of preparing the stick base material comprising a component of the insulating member and extending unidirectionally having a sectional configuration similar to that of the formation member and a sectional area larger than that of the formation member, and heating a part of the base material in a longer direction to a temperature equal to or higher than a softening point of the base material with both ends of the base material supported and elongating the base material by pushing one end of the base material toward the part in the longer direction and by pulling the other end in the same direction as the direction of pushing the one end so as to form the formation member comprising the elongated portion of the base material. Otherwise, it is preferable that the step of forming the cylindrical formation member for forming the insulating member of the electron beam apparatus supporting member comprises forming the cylindrical formation member comprising a set-up portion of the base material by heating and melting the base material comprising the component of the insulating member inside a melting pot having a hole at its bottom and by setting up the base material flowing out of the hole of the melting pot.

Furthermore, the present invention relates to a method of manufacturing a supporting member for an electron beam apparatus containing an electron source having a plurality of electron-emitting devices and a control electrode for controlling electrons emitted from the electron-emitting devices, being arranged between the electron source and the control electrode so as to support wall portions of an airtight container whose inside is kept in an almost vacuum, and comprising an insulating member on which at least one of a high resistance film and an electrode is formed, the manufacturing method comprising the steps of heating a base material comprising a component of the insulating member, forming a sheet formation member for forming the insulating member by pushing the heated base material for compression so that the base material has a predetermined thickness, forming a precursor of the high resistance film on face and rear surfaces of the sheet formation member in a process in which the sheet formation member cools down from a temperature at which the base material is compressed, forming the high resistance film on the face and rear surfaces of the sheet formation member by calcining the precursor of the high resistance film formed on the face and rear surfaces of the sheet formation member, cutting the formation in which the high resistance film is formed on the sheet formation member to make the high resistance film formed on the insulating member comprising a cut portion of the sheet formation member, and forming the electrode on a cut surface of the insulating member and of the high resistance film.

When the precursor of the high resistance film is formed on the sheet formation member, the precursor is formed by coating the sheet formation member with a solution in which a component of the high resistance film is dispersed to a solvent and vaporizing the solvent by utilizing heat of the sheet formation member so as to fix solute in the solution to the sheet formation member.

Further, when the high resistance film or the precursor of the high resistance film is formed on the formation member, it is preferable that the formation member is coated with the solution by spraying the solution including the component of the high resistance film on the formation member. In this condition, it is possible to use a plurality of injecting portions for spraying the solution when the solution including the component of the high resistance film is sprayed on the formation member. In addition, it is preferable that the formation member is coated with a solution including a component of the electrode by using a transfer roller when the electrode or the precursor of the electrode is formed on the formation member.

A supporting member for an electron beam apparatus is manufactured by using one of the above methods of manufacturing a supporting member for an electron beam apparatus.

Furthermore, an electron beam apparatus of the present invention includes the supporting member for the electron beam apparatus manufactured by using one of the above manufacturing methods as a supporting member for an electron beam apparatus.

The above electron beam apparatus may further comprise phosphor which emits light by being excited with irradiation of electrons emitted from the electron-emitting devices of the electron source in response to an input signal inputted to the electron source or an image-forming member in which an image is formed by the irradiation of the electrons emitted from the electron-emitting devices of the electron source.

In the above invention, first, with the formation of the electroconductive film on the surface of the substrate in the step of heating and drawing the substrate (base material) of the supporting member, in other words, with the formation of the electroconductive film on the surface of the substrate while it is drawn with heating, a heat at the heating and drawing can be utilized for the formation of the electroconductive film and further it is unnecessary to provide a step of molding a supporting member base from the substrate and a step of forming the electroconductive film on the molded supporting member base separately, thereby significantly reducing a process time for manufacturing a supporting member and providing a supporting member having less unevenness of a shape or characteristics.

This electroconductive film means a high resistance film or a low resistance film described later, and at least one of the resistance films is formed.

In the present invention as set forth in the above, in the cooling process of the formation member formed by heating and molding the base material comprising the component of the insulating member for manufacturing a supporting member for an electron beam apparatus being arranged in an airtight container for containing an electron source having a plurality of electron-emitting devices between the electron source and a control electrode so as to support wall portions of the airtight container and comprising an insulating member on which at least one of a high resistance film and an electrode is formed, it is possible to use the heat generated when the formation member is formed with heating the base material to be molded by forming at least one of the high resistance film and the electrode or the precursor of at least one of the high resistance film and the electrode on the formation member. Specifically, in forming the high resistance film or the precursor thereof on the formation member, the formation member is coated with the solution including the component of the high resistance film, thereby utilizing the heat generated when the formation member is formed with heating and molding the base material as an amount of heat for drying the solution so as to supplement the amount of heat. In addition, in forming the electrode or the precursor thereof on the formation member, the formation member is coated with the solution including the component of the electrode, thereby utilizing the heat generated when the formation member is formed with heating and molding the base material as an amount of heat for drying the solution so as to supplement the amount of heat. Therefore, an efficiency of utilizing the heat in manufacturing the supporting member for the electron beam apparatus. Furthermore, the present invention reduces a time loss between a step of forming the formation member for forming the insulating member which is a component of the supporting member for the electron beam apparatus and a step of forming the high resistance film or the electrode on the formation member, thereby reducing a tact time of the manufacturing process, by which it is possible to achieve a method of manufacturing a supporting member for an electron beam apparatus having a high mass production property.

The following will describe the embodiments of present invention with reference to the drawings.

FIG. 1 is a perspective view of a display panel of an image display according to one embodiment of the present invention. The image display according to the present embodiment is implemented by adapting an electron beam apparatus having an electron-emitting device and has part of its display panel partially exploded in FIG. 1 to show the internal construction of the display panel.

The image display panel of the display shown in FIG. 1 has a substrate 111 mounted on a surface of a rear plate 115.

Along the edge of the rear plate 115 is joined a side wall 116. On the surface of the rear plate 115 opposite the rear plate 115 is joined a face plate 117 opposing the rear plate 115. The face plate 117, the side wall 116, and the rear plate 115 constitute an airtight container (envelope) 131 of the display panel which is sealed to maintain the interior of the display panel at a vacuum, serving as side walls of the airtight container 131 respectively.

A junction between the rear plate 115 and the side wall 116 and a junction between the side wall 116 and the face plate 117 are coated with flit glass and baked in an air or an atmosphere of such an inactive gas as argon or nitrogen at 400 to 500° C. for 10 minutes or more, to be bonded at their respective components, thus sealing the airtight container internally. The interior of the airtight container 131 is held at a vacuum level of $10^{-6}$ Torr and, in order not to be destroyed by an atmospheric pressure or any accidental impact, has a spacer 120 as an electron beam apparatus supporting member which is obtained, as later-described with reference to FIG. 6, by forming on a insulating member a high-resistance film as a charge-preventing film and a low-resistance film as an electrode.

The substrate 111 attached to the rear plate 115 has thereon cold-cathode devices 112 in a matrix as many as N×M. Here N and M each is a positive integer of 2 or larger and appropriately set according to the number of display picture elements required on the display panel. In a display used with a high-definition TV, for example, preferably N is 300 or larger and M, 1000 or larger. The N×M number of cold-cathode devices 112 are wired in a simple matrix with an M number of row-directional wirings 113 and an N number of column-directional wirings 114. The substrate 111, the cold-cathode devices 112, the row-directional wirings 113, and the column-directional wirings 114 constitute a multi-electron-beam source 132, which is housed inside the airtight container 131.

The multi-electron-beam source 132 may be any electron source as far as it comprises a simple matrix having a plurality of cold-cathode devices and, also, there are no limitations to a method for manufacturing the cold-cathode devices 112. Therefore, the cold-cathode device 112 may include, for example, a surface conduction electron-emitting device, a field-emission (FE) device, and a metal/insulating layer/metal-type emission device (MIM-type device). This embodiment employs a surface conducting electron-emitting device as the cold-cathode device 112.

Figure 2:
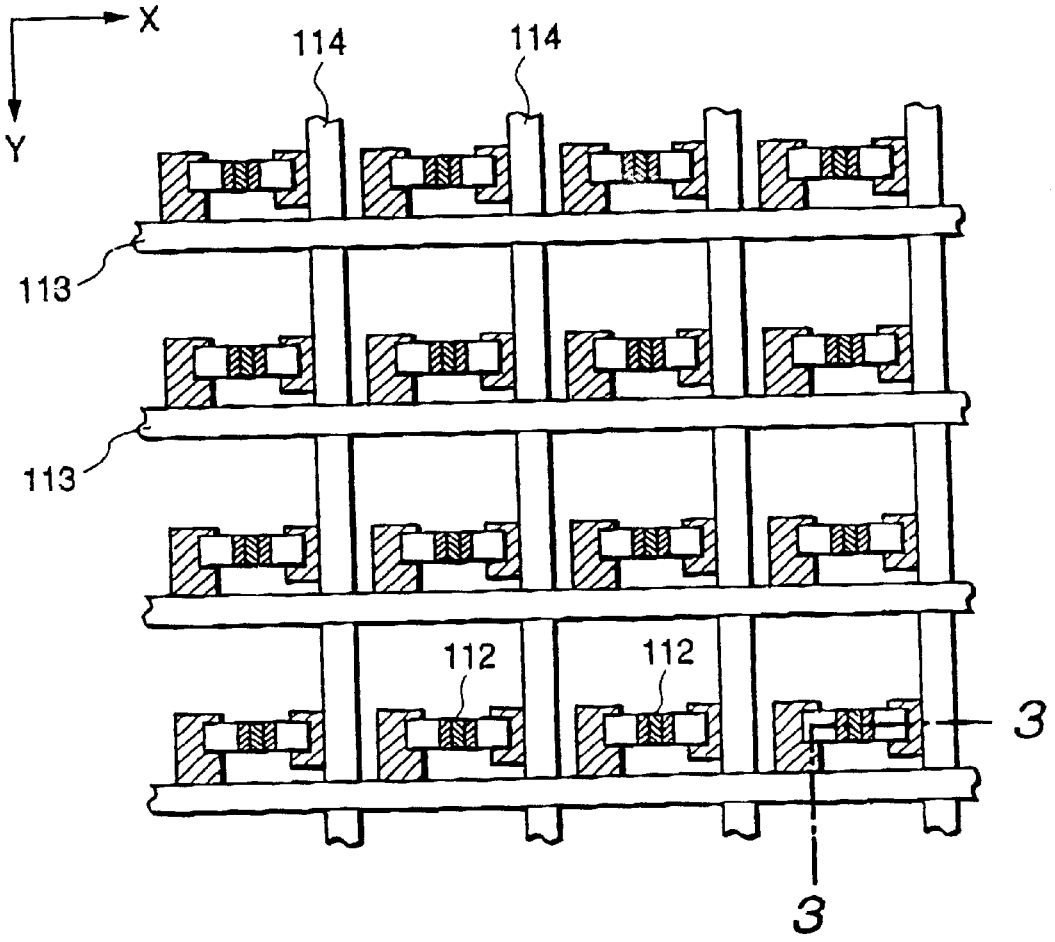
FIG. 2 is a plan view of an enlarged part of a multiple electron beam source shown in FIG. 1.
Figure 3:
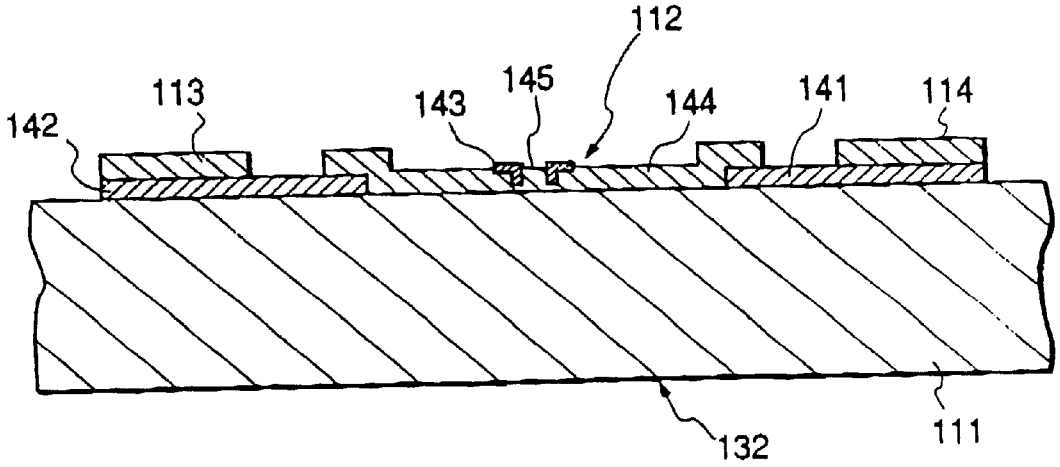
FIG. 3 is a cross-sectional view taken on line 3—3 of FIG. 2.

The following will describe a construction of the multi-electron-beam source 132 in which a plurality of surface conducting electron-emitting devices are arrayed as the cold-cathode devices 112 on the surface of the substrate 111 and wired in a simple matrix, with reference to FIGS. 2 and 3.

FIG. 2 is a plan view of an expanded part of the multi-electron-beam source 132. As shown in FIG. 2, on the substrate 111 the plurality of cold-cathode devices (surface conducting electron-emitting devices) 112 is arrayed and wired in a simple matrix consisting of the row-directional wirings 113 and the column-directional wirings 114. At each intersection of the row-directional and column-directional wirings 113 and 114 is formed an inter-wiring insulating layer (not shown), where the row-directional and column-directional wirings are electrically insulated from each other.

FIG. 3 is a cross-sectional view taken along line 3—3 of FIG. 2. As shown in FIG. 3, on the surface of the substrate 111 in the multi-electron-beam source 132, a pair of device electrodes 141 and 142 are partially formed respectively. An electroconductive thin film 144 is formed on a part of the device electrode 141 towards the device electrode 142, a part of a field of the substrate 111 between the device electrodes 141 and 142, and a part of the device electrode 142 towards the device electrode 141. A fissure portion formed at part of this electroconductive thin film 144 provides an electron-emitting region 145 for emitting electrons, which has a higher electrical resistivity than its surrounding electroconductive thin film 144. This fissure which acts as the electron-emitting region 145 is formed by carrying out an energization forming operation on the electroconductive thin film 144. Note here that in FIG. 3 the electron-emitting region 145 is schematically shown because its actual position and the geometry cannot be illustrated precisely and accurately. To emit electrons from the electron-emitting region 145, a voltage is applied to the electron-emitting region 145 via the pair of the device electrodes 141 and 142.

A thin film around the electron-emitting region 145 is made of carbon or a carbon compound, covering the electron-emitting region 145 and its vicinity. The thin film 143 is formed by carrying out an energization activation operation after an energization forming operation. Note here that in FIG. 3 the thin film 143 is schematically shown because its actual position and geometry cannot be illustrated precisely and accurately. The electron-emitting region 145 and a part of the electroconductive thin film 144 covered with the thin film 143 and the device electrodes 141 and 142 constitute the cold-cathode device 112.

To manufacture the multi-electron-beam source 132 having such a configuration as mentioned above, it is necessary to beforehand form the row-directional and column directional wirings 113 and 114, the inter-electrode insulating layer (not shown), the device electrodes 141 and 142, and the electroconductive thin film 144 on the substrate 111. Next, each cold-cathode device 112 is supplied with electricity via the row-directional and column-directional wirings 113 and 114, to carry out necessary operations such as an energization forming operation and an energization activation operation, thus manufacturing the multi-electron-beam source 132. Although this embodiment has employed such a configuration that on the read plate 115 of the airtight container 131 is attached the substrate 111 of the multi-electron-beam source 132, the substrate 111 itself of the multi-electron-beam source 132 may be used as the rear plate of the airtight container 131 as far as it has sufficient strength.

Also, as shown in FIG. 1, on the back side of the face plate 117 facing the rear plate 115 is formed a phosphoric film 118. Since an image display according to this embodiment is a color display, the phosphoric film 118 is comprised of three-primary colors of red (R), green (G), and blue (B) used on a Braun tube (CRT) which is painted respectively.

Figure 4:
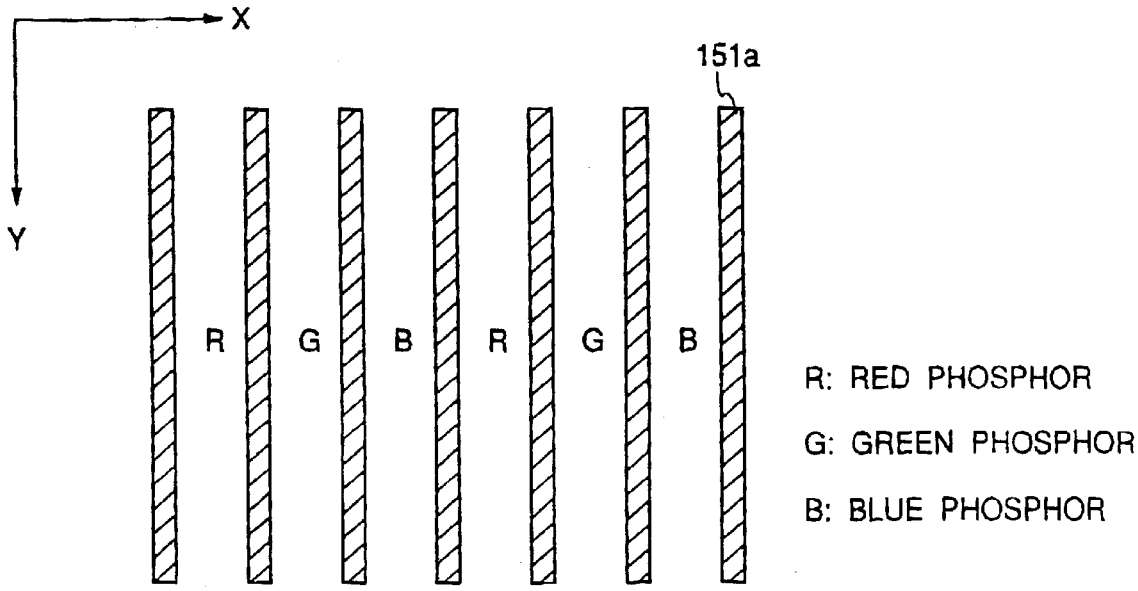
FIG. 4 is a plan view illustrating a pattern of phosphor having three primary colors formed as a phosphor film shown in FIG. 1.
Figure 5:
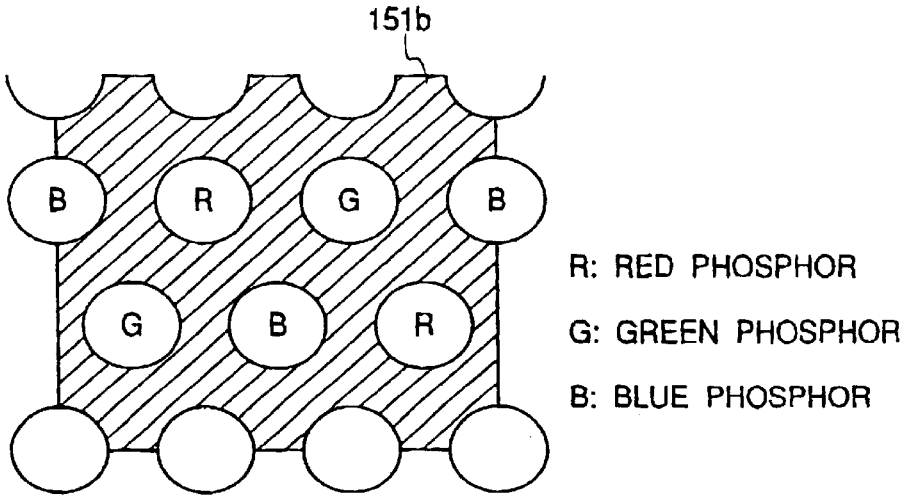
FIG. 5 is a plan view illustrating an example of a deformed pattern of the phosphor of the phosphor film shown in FIG. 1.

FIG. 4 is a plan view showing a pattern of three-primary-color phosphors formed as the phosphoric film 118. FIG. 5 is a plan view showing a variation of the pattern of the phosphors of the phosphoric film 118. These colors of the phosphors of the phosphoric film 118 are, as shown for example in FIG. 4, painted in stripes separately from each other, in such a configuration that thus formed stripe-shaped phosphors have an electroconductive black material 151*a* formed therebetween. The electroconductive black material 151*a* is provided in order to preclude any shifts in colors displayed on the display surface even if an electron beam is shifted to some extent on the phosphoric film 118, to prevent deterioration in the display contrast by precluding reflection of external lights, and to prevent charge-up of the phosphoric film 118 by electron beams. Although the above-mentioned electroconductive black material has used graphite as its main component, any other material may be used as far as it fits the above-mentioned purposes.

Also, the above-mentioned respective painting of the three primary colors of the phosphoric film 118 is not limited to a stripe-shaped array shown in FIG. 4 but may come in a delta-shaped one shown in FIG. 5 etc. In the pattern of phosphors shown in FIG. 5 also, an electroconductive material 151*b* is formed between the phosphors based on an array of these phosphors. The purposes of forming and the materials of the electroconductive black material 151*b* are the same as those for the electroconductive black material 151*a*. Note here that to fabricate a monochromatic display panel, a single-color phosphoric material may be used as the phosphoric film 118 and also that the electroconductive black materials 151*a* and 151*b* need not always be formed.

On the surface of the phosphoric film 118 facing the rear plate 115 is formed a metal back 119 made of aluminum which is publicly known in an application field of CRTs. The metal back 119 is thus formed in order to improve optical utilization efficiency by reflecting part of a light emitted from the phosphoric film 118, to protect the phosphoric film 118 from attacks of negative ions, to cause itself to act as an electrode to which voltage is applied for accelerating an electron beam, and to excite the phosphoric film 118 so as to cause it to act as a conducting path for electrons. Therefore, the metal back 119 is used also as a control electrode for controlling electrons emitted from the cold-cathode device 112 in such a manner as to apply voltage on and accelerate electrons emitted from the cold-cathode device 112. The metal back 119 is formed by forming the phosphoric film 118 on the face plate 117 and then smoothing the surface of the phosphoric film 118 to evaporate aluminum in vacuum on the surface of the phosphoric film 118. Note here that the metal back 119 is not used when a low-voltage-application phosphoric material is used as the material of the phosphoric film 118 or when the acceleration voltage is low or also when a higher brightness can be obtained without the metal back 119.

Although it is not used in the image display according to this embodiment, a transparent electrode made of for example ITO may be used between the face plate 117 and the phosphoric film 118 in order to apply acceleration voltage or to improve conductivity of the phosphoric film 118.

Figure 6:
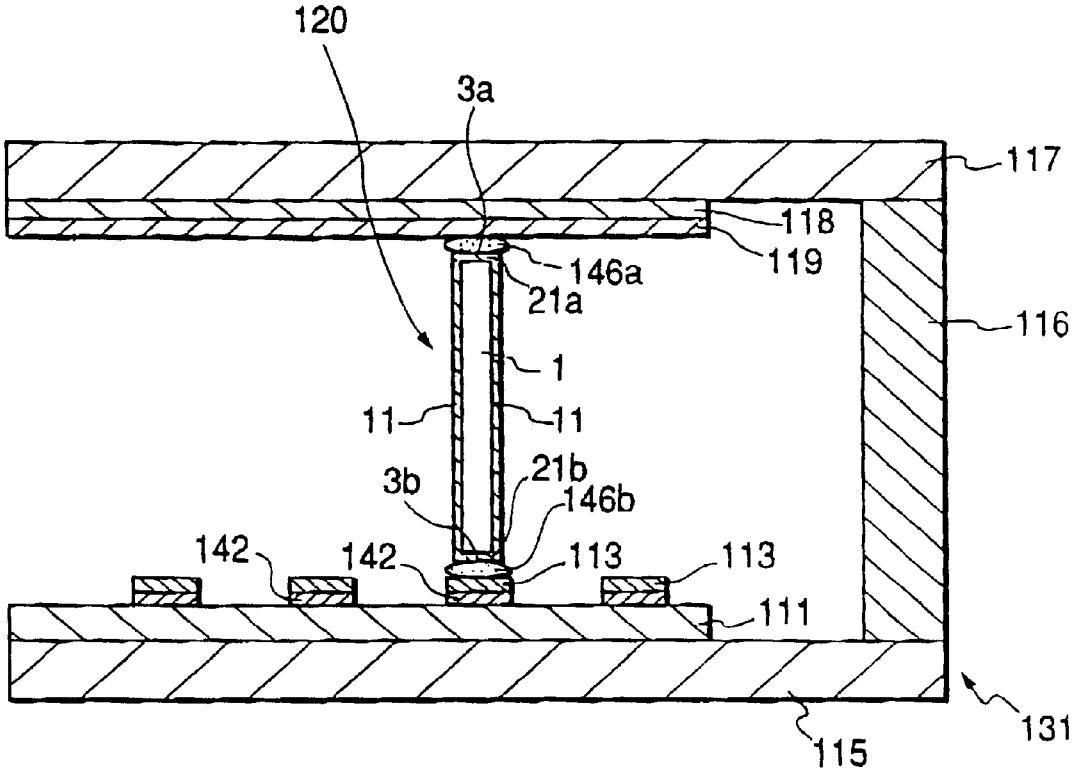
FIG. 6 is a cross-sectional view taken on line 6—6 of FIG. 1.

FIG. 6 is a cross-sectional view taken along line 6—6 of FIG. 1. As shown in FIG. 6, the space 120, which acts as an electron beam apparatus supporting member, is obtained by forming a high-resistance film 11 on the whole surfaces of two sides which provide a surface having a maximum area on an insulating substrate 1 as an insulating material which constitutes the spacer 120 and then forming a low-resistance film 21*a* as one spacer electrode on one end surface 3*a* of the insulating substrate 1 facing the face plate 117 and another low-resistance film 21*b* as the other spacer electrode on the other end surface 3*b* of the insulating substrate facing the rear plate 115. The material of the insulating substrate 1 may include glass or glass fiber. The respective high-resistance films 11 are formed in order to prevent the spacer 120 surface from being charged, coming in contact with the low-resistance films 21*a* and 21 to be electrically connected with them.

Thus obtained spacer 120 is arranged between the multi-electron-beam source 132 and the metal back 119 in the airtight container 131 at such an interval and as many a number that are required to support the rear plate 115 and the face plate 117 against the atmospheric pressure. A joining material 146*a* is provided to attach the low-resistance film 21*a* to the metal back 119 which provides the inner side of the face plate 117, while a joining material 146*b* is provided to attach the low-resistance film 21*b* onto the substrate 111. Note here that the low-resistance film 21*b* is arranged on the surface of the row-directional array 113.

The low-resistance film 11 is electrically connected via the low-resistance film 21*a* and the joining material 146*a* to the inside of the face plate 117 of for example the metal back 119 and also to the row-directional or column-directional wiring 113 or 114 on the surface of the substrate 111 via the low-resistance film 21*b* and the joining material 146*b*. In this embodiment, the spacers 120 are shaped into a thin plate and arranged in parallel with the row-directional wirings 113, to be electrically connected with them The spacer 120 must have a dielectric strength high enough to stand a high voltage applied between the metal back 119*b* and the row-directional and column-directional wirings 113 and 114. The material of the insulating substrate which constitutes the spacer 120 is not limited to the above-mentioned materials but may include glass with reduced contents of impurities such as Na, soda lime glass, and ceramic such as alumina. The insulating substrate 1 preferably has a thermal expansion rate which is near that of members which constitute the airtight container 131 and the substrate 111.

Through the high-resistance film 11 which constitutes the spacer 120 flows a current that is obtained by dividing an acceleration voltage value Va applied to the metal back 119 or the face plate 117 of the high-voltage side by a resistance value Rs of the high-resistance film 11 which provides charge-preventing film. Therefore, the resistance Rs for the spacer 120 is set in such a preferable range as to prevent charging and reduce power dissipation. From a viewpoint of preventing charging, a sheet resistance R of the high-resistance film 11 is preferably $10^{12}$ Ω/□ or less. To further improve the effects of preventing charging, the sheet resistance R of the high-resistance film 11 should preferably be $10^{11}$ Ω/□ or less. The lower limit of the sheet resistance of the high-resistance film 11 is preferably $10^5$ Ω/□, depending on a voltage applied between the adjacent spacers 120. From the viewpoint of the above, the sheet resistance of the high-resistance film 11 should preferably be $10^9$ to $10^{14}$ Ω/□.

A thickness t of the high-resistance film 11 which acts as a charging-preventing film formed on the surface of the insulating substrate 1 is preferably 10 nm to 1 μm. The thickness t of the high-resistance film 11 depends on the surface energy of the component materials, the adhesion between the high-resistance film 11 and the insulating substrate 1, and the temperature of the insulating substrate 1 but if it is 10 nm or less, generally the film 11 is formed in an island shape having such an electrical resistance that is unstable and poor in reproducibility. When the thickness t is 1 μm or more, on the other hand, it has a larger film stress and is more likely to be delaminated and have poorer mass-productivity because of elongated time required for forming films. Therefore, the film thickness of the high-resistance film 11 is preferably 50 to 500 nm. Supposing the specific resistance of the high-resistance film 11 to be ρ and its film thickness to be t, the sheet resistance of the high-resistance film 11 is ρ/t, so that the specific resistance ρ of the high-resistance film 11 is preferably 0.1 to $10^8$ Ωcm based on the above-mentioned preferable range of the sheet resistance R and the film thickness t. To realize better ranges for the sheet resistance and film thickness of the high-resistance film 11, the specific resistance ρ is preferably $10^2$ to $10^6$ Ωcm.

In the spacer 120, when a current flows through the high resistance film 11 formed on the surface of the insulating substrate 1 as described above, or the entire display panel generates heat during operation, the temperature of the spacer 120 rises. Here, when the resistance temperature coefficient of the high resistance film 11 has a large negative value, and when the temperature of the spacer 120 rises, the resistance value of the high resistance film 11 decreases, and the current flowing through the spacer 120 increases, which further raises the temperature of the spacer 120. In this case, the current flowing through the spacer 120 continues to increase until the limit of the power supply is exceeded. The value of the resistance temperature coefficient at which the runaway of the current is caused in the spacer 120 in this manner is empirically a negative value, and the value is −1%/° C. or less. Specifically, the resistance temperature coefficient of the high resistance film 11 is preferably more than −1%/° C.

As the material of the high resistance film 11 having a charging preventive property in the spacer 120, for example, metal oxides can be used. Among the metal oxides, oxide of chromium, nickel, or copper is a preferable material. The reason is that this oxide has a relatively small secondary electron-emitting efficiency, and it is supposed that even when the electron emitted from the cold cathode device 112 strikes the spacer 120, the spacer 120 is difficult to charge. Besides the above-described metal oxides, carbon is preferable as the material of the high resistance film 11 because of its small secondary electron-emitting efficiency. Particularly, since non-crystalline carbon has a high resistance, the resistance value of the spacer 120 can easily be controlled to provide a desired value by using non-crystalline carbon as the material of the high resistance film 11.

As another material of the high resistance film 11 provided with the charging preventing property, nitride of aluminum and transition metal alloy is a preferable material because the resistance value can be controlled in a broad range to an insulating material from a good conductive material by adjusting the composition of the transition metal. Moreover, the nitride of aluminum and transition metal alloy indicates only a small resistance value change and is a stable material in the manufacture process of the display described later. Furthermore, the resistance temperature coefficient of nitride is more than −1%/° C., and the nitride of aluminum and transition metal alloy is practically easily usable material. Examples of transition metal elements include Ti, Cr, Ta, and the like.

The alloy nitride film formed as the high resistance film 11 is formed on the surface of the insulating substrate 1 by thin film formation processes such as sputtering, reactive sputtering in a nitrogen gas atmosphere, electron beam deposition, ion plating, and ion assist deposition process. A metal oxide film can also be formed in the similar thin film formation process, but in this case, an oxygen gas is used instead of a nitrogen gas. Additionally, a metal oxide film can also be formed as the high resistance film 11 by a CVD process, or an alkoxide application process. When a carbon film is formed as the high resistance film 11, the carbon film is formed by the deposition process, sputtering process, CVD process, or plasma CVD process. Particularly when a non-crystalline carbon film is formed, hydrogen is contained in a film formation atmosphere, or a hydrocarbon gas is used as the film formation gas The low resistance films 21*a*, 21*b* constituting the spacer 120 are formed to electrically connect the high resistance film 11 to face plate 117 (metal back 119, and the like) on a high potential side and substrate 111 (row-directional wiring 113, column-directional wiring 114, and the like) on a low potential side, and these low resistance films 21*a*, 21*b* form the electrodes of the spacer 120 (hereinafter also referred to as the spacer electrodes). Each of the low resistance films 21*a*, 21*b* as the spacer electrodes can be provided with the following three functions.

First, as the first function given to the low resistance films 21*a*, 21*b* as the spacer electrodes, for example, the high resistance film 11 is electrically connected to the face plate 117 and the substrate 111 by the low resistance films 21*a*, 21*b*.

As described above, the high resistance film 11 is formed for the purpose of preventing the charging on the surface of the spacer 120, but when the high resistance film 11 is connected to the face plate 117 (metal back 119, and the like) and substrate 111 (row-directional wiring 113, column-directional wiring 114, and the like) directly or via connecting members 146*a*, 146*b*, a large contact resistance is generated in a connected portion interface, and there is a possibility that electric charges generated on the surface of the spacer 120 cannot quickly be removed. To avoid this, the low resistance films 21*a*, 21*b* are formed on the spacer 120, and the contact portions of the spacer 120 with the face plate 117, substrate 111 and connecting members 146*a*, 146*b* are formed by the low resistance films 21*a*, 21*b* as the low-resistance spacer electrodes.

Subsequently, as the second function given to the low resistance films 21*a*, 21*b* as the spacer electrodes, the potential distribution of the high resistance film 11 is uniformed. The electron emitted from the cold cathode device 112 constitutes an electron trajectory according to the potential distribution formed between the face plate 117 and the substrate 111. In order to prevent turbulence from occurring in the electron trajectory in the vicinity of the spacer 120, the potential distribution of the high resistance film 11 needs to be controlled over the entire area of the film. When the high resistance film 11 is connected to the face plate 117 (metal back 119, and the like) and substrate 111 (row-directional wiring 113, column-directional wiring 114, and the like) directly or via the connecting members 146*a*, 146*b*, non-uniformity is generated in the connected state because of the contact resistance of the connected portion interface, and the potential distribution of the high resistance film 11 possibly deviates from the desired value. To avoid this, by forming the low resistance films 21*a*, 21*b* as the low-resistance spacer electrodes on the entire area of the surfaces of the spacer ends of the spacer 120 abutting on the face plate 117 and substrate 111 (end surfaces 3*a*, 3*b* and side surfaces 5*a*, 5*b*), and applying a desired potential to the spacer electrode portion, the potential of the entire high resistance film 11 can be controlled.

Furthermore, as the third function given to the low resistance films 21*a*, 21*b* as the spacer electrodes, the trajectory of the electron emitted from the cold cathode device 112 is controlled. The electron emitted from the cold cathode device 112 constitutes the electron trajectory according to the potential distribution between the face plate 117 and the substrate 111. For the electron emitted from the cold cathode device 112 in the vicinity of the spacer 120, there are restrictions (such as the change of the position of the cold cathode device 112 or the device wiring) with the installation of the spacer 120 in some cases. In this case, in order to form an image without any strain or nonuniformity, the trajectory of the electron emitted from the cold cathode device 112 needs to be controlled to irradiate the desired position on the face plate 117 with the electron. By forming the low resistance films 21*a*, 21*b* as the low-resistance spacer electrodes on the side faces 5 of the abutment portions of the spacer 120 abutting on the face plate 117 and substrate 111, and providing the potential distribution in the vicinity of the spacer 120 with the desired property, the trajectory of the emitted electron can be controlled.

As the materials of the low resistance films 21*a*, 21*b*, materials having resistance values sufficiently lower than the value of the high resistance film 11 may be selected, and metals such as Ni, Cr, Au, Mo, W, Pt, Ti, Al, Cu, and Pd, or alloys may be used. Furthermore, the material is appropriately selected from: a printing conductor formed of metals such as Pd, Ag, and Au, metal oxides such as $RuO_2$, and Ag—PdO, glass, and the like; a conductive fine particle dispersed film in which conductive fine particles obtained by doping fine particles of semiconductor materials such as $SnO_2$ with dopants such as Sb are dispersed in an inorganic or organic binder; and semiconductor materials such as $In_2O_3$—$SnO_2$ and other transparent conductors and polysilicon.

The connecting members 146*a*, 146*b* need to be provided with electroconductive properties so that the spacer 120 is electrically connected to the row-directional wiring 113 and metal back 119. Therefore, as the materials of the connecting members 146*a*, 146*b*, conductive adhesive materials, metal particles, fritted glass with a conductive filler added thereto, and the like are preferable.

Moreover, attached to side wall 116 are airtight structure electric connecting terminals Dx1 to Dxm, Dy1 to Dyn and Hv for electrically connecting the row-directional wiring 113, column-directional wiring 114 and metal back 119 of the display panel to an electric circuit (not shown) outside the display panel. These terminals are protruded to the outside of airtight container 131 from the side wall 116. Each of the terminals Dx1 to Dxm is electrically connected to the row-directional wiring 113 corresponding to each of the terminals Dx1 to Dxm, each of the terminals Dy1 to Dyn is electrically connected to the column-directional wiring 114 corresponding to each of the terminals Dy1 to Dyn, and the terminal Hv is electrically connected to the metal back 119.

In order to exhaust air from the airtight container 131 to obtain a vacuum state inside the container, after assembling the airtight container 131, an exhaust tube and vacuum pump (not shown) disposed in the airtight container 131 are connected, and the vacuum pump is driven to exhaust the air from the airtight container 131 until a vacuum degree of about $10^{-7}$ Torr is obtained. subsequently, the exhaust tube of the airtight container 131 is sealed, but to maintain the vacuum degree inside the airtight container 131, a getter film (not shown) is formed on a predetermined position in the airtight container 131 immediately before and after the sealing. The getter film is deposited and formed by heating the getter material mainly containing, for example, Ba with a heater or by high-frequency heating, and the pressure inside the airtight container 131 is maintained to provide the vacuum degree of $1\times10^{-5}$ to $1\times10^{-7}$ Torr by the adsorption action of the getter film.

In the image display using the above-described display panel, when the voltage is applied to the cold cathode devices 112 via the outwardly protruded terminals Dx1 to Dxm, Dy1 to Dyn of the airtight container 131, electrons are emitted from the cold cathode devices 112. At the same time, by applying a high pressure of several hundreds of volts to several kilovolts to the metal back 119 via the terminal Hv outside the container, and accelerating the electrons emitted from the cold cathode devices 112, the accelerated electrons are allowed to strike the inner surface of the face plate 117. Thereby, each color phosphor constituting fluorescent film 118 is excited to emit light, and the image is displayed on the display surface of the display panel.

Usually, the voltage applied to the surface conduction electron-emitting device used as the cold cathode device 112 in the present embodiment is of the order of 12 to 16 V, distance d between the metal back 119 and the cold cathode device 112 is of the order of 0.1 to 8 mm, and a voltage between the metal back 119 and the cold cathode device 112 is of the order of 0.1 to 10 kV.

A method of manufacturing the spacer 120 will next be described as a method of manufacturing a supporting member for an electron beam apparatus with reference to FIGS. 1 and 6.

In the method of manufacturing the spacer 120, by heating and molding/processing a base material formed of materials constituting the insulating substrate 1, a formation member for forming the insulating substrate 1 is formed. Subsequently, in the process of cooling the formation member to an atmospheric temperature around the formation member, by forming the high resistance film 11, low resistance film 21*a*, 21*b*, or a precursor of the high resistance film 11 or low resistance film 21*a*, 21*b* on the formation member, the heat during formation of the formation member by heating and molding/processing the base material is utilized in forming the high resistance film 11, electrode 21*a*, 21*b*, or the precursor thereof.

Specifically, during the forming of the high resistance film 11, or the precursor of the high resistance film 11 on the formation member, by applying a solution containing the materials constituting the high resistance film 11 to the formation member, the heat during the forming of the formation member by heating and molding/processing the base material is utilized as the amount of heat for drying the solution, and a part of the heat amount is compensated. Moreover, when the low resistance films 21*a*, 21*b*, or the precursors of the low resistance films 21*a*, 21*b* are formed on the formation member, by applying the solution containing the materials constituting the low resistance films 21*a*, 21*b* to the formation member, the heat during the forming of the formation member by heating and molding/processing the base material is utilized as the amount of heat for drying the solution, and a part of the heat amount is compensated.

Subsequently, by cutting the formation member with the high resistance film 11 and low resistance films 21*a*, 21*b* formed thereon, the spacer 120 shown in FIGS. 1 and 6 in which the high resistance film 11 and low resistance films 21*a*, 21*b* are formed on the insulating substrate 1 constituted of the cut portion of the formation member is manufactured. In the manufacture method, the utilization efficiency of the heat during the manufacture of the spacer 120 is enhanced. Furthermore, a time loss is reduced between the process of forming the formation member to form the insulating substrate 1 and the process of forming the high resistance film 11 or the electrode 21*a*, 21*b* on the formation member, and the tact time of the manufacture process is minimized, so that the electron beam apparatus supporting member manufacture method very high in mass productivity is realized.

Furthermore, by using the material of glass or glass fiber in the insulating substrate 1 constituting the spacer 120, the electron beam apparatus low in cost, easy in processings such as cutting and abrading, and satisfactory in assembling strength can be prepared.

As described above, in the display panel of the image display of the present embodiment, by using the surface conduction cold cathode device having the electroconductive film including the electron-emitting region between the electrodes as the electron-emitting device, the structure of the device can easily be obtained with a high luminance.

Moreover, the region on which a latent image can be formed by various materials from the standpoint of image recording can be used as the region irradiated with electron beams, but when the electron beam irradiated region is formed of phosphor, the image display which can inexpensively provide a dynamic image can be obtained.

Furthermore, by using an image-forming member for forming an image when irradiated with electrons emitted from the electron-emitting device in response to an input signal as the electron beam irradiated region, instead of the fluorescent film 118, the electron beam apparatus can be applied to an image-recording apparatus as the image-forming apparatus. For example, by using the electron beam apparatus applied to the image display of the present embodiment as a light emitting source to replace the light emitting diode of an optical printer comprising a photosensitive drum and the light emitting diode, the image recording apparatus can be constituted. In this case, by appropriately selecting m pieces of row-directional wiring and n pieces of column-directional wiring, the source can be applied not only as a linear light emitting source but also as a two-dimensional light emitting source. In this case, the member on which the latent image is formed by electron charging can be used as the image-forming member. The electron beam apparatus using the spacer of the present embodiment can also be applied, for example, to an electron microscope in which the electron beam irradiated region of the electrons emitted from the electron source is other than the image-forming member of phosphor. Therefore, the present invention can be embodied as a general electron beam apparatus in which the electron beam irradiated region is not specified.

EXAMPLES

The method of manufacturing the electron beam apparatus supporting member of the present invention will mainly be described in the following examples.

First Example

Figure 7:
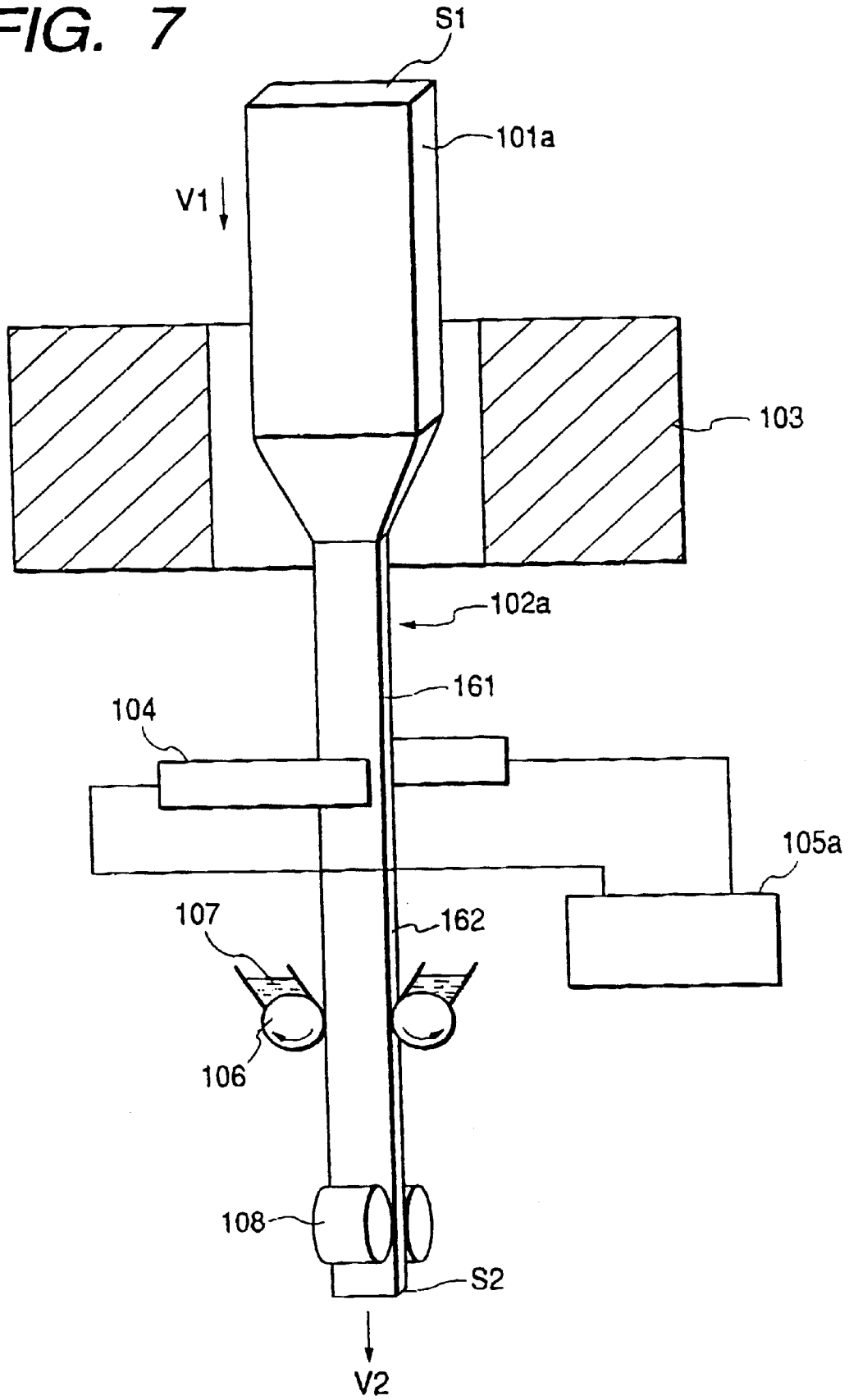
FIG. 7 is a diagram typically showing an apparatus used for a method of manufacturing a supporting member for an electron beam apparatus of a first embodiment according to the present invention.
Figure 8:
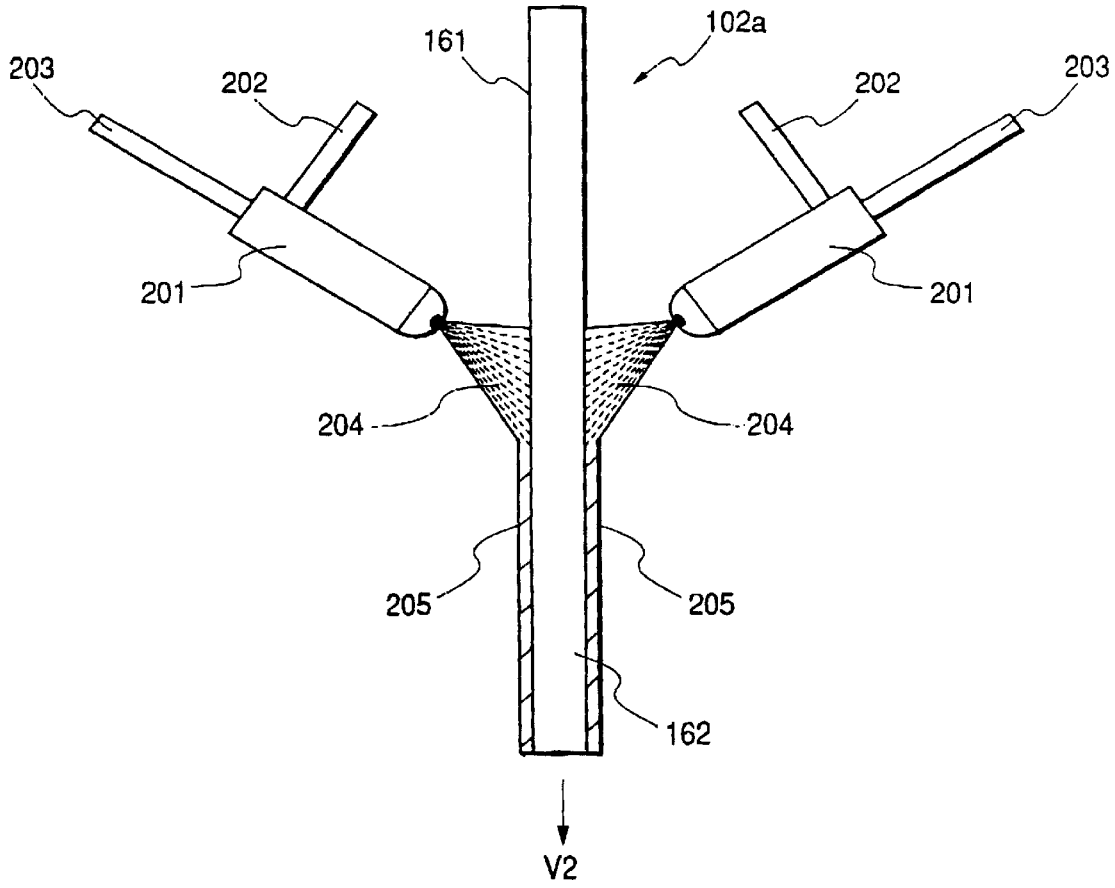
FIG. 8 is a diagram of assistance in explaining a process of forming a high resistance film in a spray head portion shown in FIG. 7.
Figure 9:
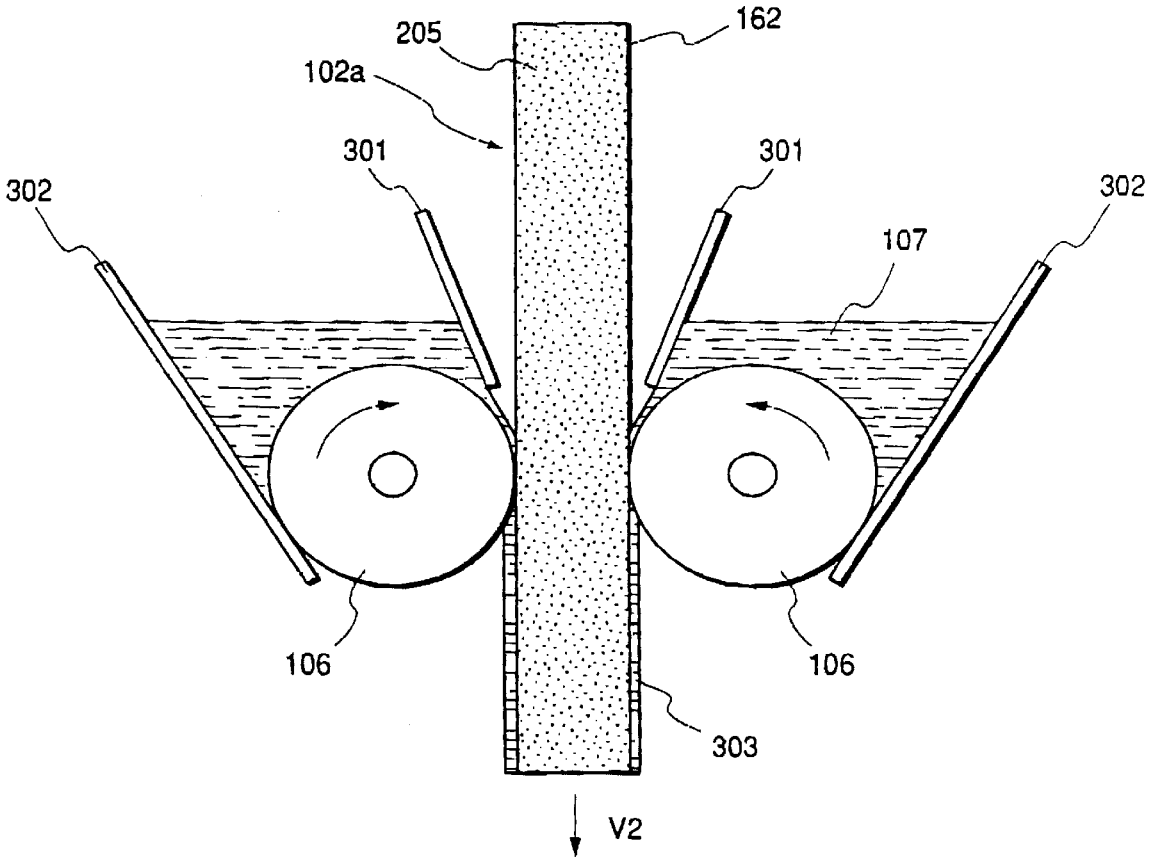
FIG. 9 is a diagram of assistance in explaining a process of forming a spacer electrode by using a transfer roller shown in FIG. 7.

FIGS. 7 to 9 are explanatory views showing the method of manufacturing the spacer 120 shown in FIGS. 1 and 6 as the method of manufacturing the electron beam apparatus supporting member of a first example of the present invention. FIG. 7 is a schematic view showing the apparatus fo use in the method of manufacturing the electron beam apparatus supporting member of the present example. FIG. 8 is an explanatory view of a process of forming the high resistance film in a spray head section shown in FIG. 7, and FIG. 9 is an explanatory view of a process of using a transfer roller shown in FIG. 7 to form the spacer electrode.

In the method of manufacturing the electron beam apparatus supporting member of the present example, as shown in FIG. 7, a heater 103 is used to heat a part of a glass base material 101*a* which is the same constituting material as that of the insulating substrate (supporting member base) 1. First, the glass base material 101*a* formed of the materials constituting the insulating substrate 1 is prepared to form the insulating substrate 1. The glass base material 101*a* has a rectangular sectional shape, and is extended like a bar in one direction while the sectional shape of the glass base material 101*a*, and sectional area S1 are substantially constant. By heating a part of the longitudinal direction of the glass base material 101*a* by the heater 103 to a softening point of the material constituting the glass base material 101*a* or a higher temperature, simultaneously drawing the heated portion of the glass base material 101*a*, that is, performing heating/drawing and molding, a glass material 102*a* having the same sectional area S2 as the sectional area of the insulating substrate 1 of the spacer 120 is prepared as the formation member for forming the insulating substrate 1. Therefore, the glass material 102*a* is constituted of the drawn portion of the glass base material 101*a*. The high resistance film is formed on the glass material 102*a* by a spray head region 104 controlled by a controller 105*a*, and further by applying a transfer application solution 107 to the glass material 102*a* by a transfer roller 106, the spacer electrode is formed on the glass material 102*a*.

Here, the glass base material 101*a* is fed in a direction toward the heater 103 with a feed velocity V1, and the end on the downstream side of the feed direction of the glass base material 101*a*, that is, the end of the glass material 102*a* opposite to the side of the heater 103 is drawn by a drawing roller 108 in the same direction as the feed direction of the glass base material 101*a* with a drawing velocity V2.

The sectional shape of the glass base material 101*a* is analogous to the sectional shape of the glass material 102*a*, and the sectional area S2 of the glass material 102*a* is smaller than the sectional area S1 of the glass base material 101*a*. In the present example, the heating, drawing and molding were performed so that the sectional dimension of the glass material 102*a* was 1.8 mm×0.2 mm, and the sectional size of the glass base material 101*a* was set to be ten times that of the glass material 102*a*. Moreover, PD 200 manufactured by Asahi Glass Co., Ltd. was used as the material of the glass base material 101*a*, and the heating temperature of the glass base material 101*a* by the heater 103 was set to about 700° C.

Two large side surfaces out of four side surfaces of the glass material 102*a* correspond to high resistance film forming surfaces 161 on which the high resistance films are formed by the spray head region 104, and two small side surfaces correspond to electrode forming surfaces 162 on which the spacer electrodes are formed by the transfer roller 106.

The ratio of the analogous shape of the sections of the glass base material 101*a* and glass material 102*a*, the heating temperature by the heater 103, the feed velocity V1 of the glass base material 101*a*, and the drawing velocity V2 of the glass material 102*a* are dependent on the material type of the glass base material 101*a*, the processed shape of the heating, drawing and molding, and the like, but the analogous shape ratio of several times to several hundreds of times, and the heating temperature equal to or higher than the softening point of the glass base material 101*a* can be applied. The temperature for heating the glass base material 101*a* in the heating, drawing and molding is usually set in a range of 500 to 800° C. Moreover, the feed velocity V1 of the glass base material 101*a* needs to be smaller than the drawing velocity V2 of the glass material 102*a*, but the optimum conditions of the velocities can arbitrarily be determined. In the present example, the heating, drawing and molding of the glass base material 101*a* were performed with the feed velocity V1 of 1 m/min, and the drawing velocity V2 of 10 m/min.

A method of forming the high resistance film on the glass material 102*a* will next be described with reference to FIG. 8.

The spray head region 104 shown in FIG. 7 is provided with a plurality of spray heads 201 as spray sections as shown in FIG. 8 in order to form the high resistance film on each high resistance film forming surface 161 of the glass material 102*a*. Each spray head 201 is connected to one end of an application solution supply line 202 for supplying to the spray head 201 an application solution 204 to be sprayed to the glass material 102*a* from the spray head 201 in a mist form. Moreover, each spray head 201 is connected to one end of a gas supply line 203 for supplying to the spray head 201 the gas for use in spraying the application solution 204 via the spray head 201.

In the present example, as the application solution 204 for forming the high resistance film, silicon and carboxylic acid of tin oxide having a metal mixture molecular ratio of 2:1 were dissolved in an octane solvent at a carboxylic acid concentration of 10 mol/l for use. By spraying the application solution 204 to the glass material 102*a* from the spray head 201 of the spray head region 104 in a mist state by nitrogen gas controlled by the controller 105*a* and supplied to the spray head 201 through the gas supply line 203, the application solution 204 was applied to the high resistance film forming surfaces 161, that is, both surfaces of the glass material 102*a*. When the application solution 204 applied to each high resistance film forming surface 161 adheres to the high resistance film forming surface 161, a high resistance film 205 is formed on the high resistance film forming surface 161.

Here, the heat for heating the glass base material 101*a* to form the glass material 102*a* by the molding/processing is utilized as the amount of heat for forming the high resistance film 205, and a part of the heat amount is compensated by the heat during the heating of the glass base material 101*a*. In this case, a part of the heat for heating the glass base material 101*a* is utilized as the heat amount for drying the application solution 204.

In the present example, the feed direction of the glass base material 101*a*, and the drawing direction of the glass material 102*a* were set to substantially agree with a gravity force direction, and the spray head 201 was inclined to perform spraying so that the spray direction of each spray head 201 formed an angle of about 40° to the high resistance film forming surface 161 from its state vertical to the high resistance film forming surface 161.

This process of forming the high resistance film 205 on the high resistance film forming surface 161 is performed in the process of cooling the temperature for heating the glass base material 101*a* to mold/process the glass base material 101*a* down to the atmospheric temperature around the glass material 102*a*. Additionally, in the present example, when the surface temperature of the part of the high resistance film forming surface 161 in the vicinity of the spray head 201 was measured during the spraying by the spray head 201, 400° C. was obtained.

Additionally, as the application solution 204, various materials including a simplex material and a composite material can be applied as long as the material can be applied to the glass material 102*a* by the spray head 201 and its specific resistance value is of the order of 1E5 to 1E9 Ωcm.

A method of using the transfer roller 106 to form the spacer electrode on the glass material 102*a* will next be described with reference to FIG. 9. As shown in FIG. 9, the transfer roller 106 applies an application solution 107 in a container 302 to an electrode forming surface 162 of the glass material 102*a*. The application solution 107 contains materials for forming the spacer electrode on the electrode forming surface 162. The application solution 107 in the container 302 is applied to the surface of the transfer roller 106 by a blade 301, and the application solution 107 applied to the surface of the transfer roller 106 is applied to the surface of the electrode forming surface 162 with the rotation of the transfer roller 106. Thereafter, when the application solution 107 applied to the surface of the electrode forming surface 162 solidifies by the heat used for heating the glass material 102*a* by the heater 103 to perform the heating/drawing/molding, two spacer electrodes 303 are formed on the electrode forming surface 162. The spacer electrodes 303 formed on the electrode forming surface 162 contact two high resistance films 205, and are electrically connected to the high resistance films 205.

In the present example, silver paste was used as the material of the application solution 107. Moreover, as the transfer roller 106, the roller with 4 μm deep linear grooves extended in parallel with the rotation axis of the transfer roller 106 and formed on the surface at a pitch of 10 μm was used. For the pitch of the grooves formed on the transfer roller 106, the size of the transfer roller 106, and the rotation velocity of the transfer roller 106, arbitrary values can appropriately be selected in accordance with the viscosity and particle properties of the application solution 107, the application thickness of the application solution 107, and the drawing velocity V2 of the glass material 102*a*.

This process of forming the spacer electrode 303 on the electrode forming surface 162 is performed in the process of cooling the temperature in forming the high resistance film 205 on the high resistance film forming surface 161 down to the atmospheric temperature around the glass material 102*a*. Additionally, in the present example, when the surface temperature of the part of the electrode forming surface 162 in the vicinity of the transfer roller 106 was measured during the applying of the application solution 107 by the transfer roller 106, 360° C. was obtained.

Moreover, in the process of forming the spacer electrode 303, the heat used for heating the glass base material 101*a* to form the glass material 102*a* by the molding/processing is utilized as the heat amount for forming the spacer electrode 303, and a part of the heat amount is compensated by the heat used for heating the glass base material 101*a*. In this case, a part of the heat used for heating the glass base material 101*a* is utilized as the heat amount for drying the application solution 107.

As the material of the application solution 107, various materials can appropriately be selected and applied as long as the material can be applied to the electrode forming surface 162 by the transfer roller 106 and its specific resistance value is 1E5 Ωcm or less.

By cutting the glass material 102*a* with the high resistance film 205 and spacer electrode 303 formed thereon to a predetermined length, the spacer 120 shown in FIGS. 1 and 6 is manufactured. Here, the insulating member of the electron beam apparatus supporting member is constituted of the cut portion of the glass material 102*a*, the cut portion of the glass material 102*a* corresponds to the insulating substrate 1 shown in FIG. 6, and the high resistance film 205 corresponds to the high resistance film 11 shown in FIG. 6. One of two spacer electrodes 303 corresponds to the low resistance film 21*a* shown in FIG. 6, and the other corresponds to the low resistance film 21*b* shown in FIG. 6.

When the spacer 120 manufactured through the above-described processes was used to prepare a display similar to the image display shown in FIG. 1, a high-quality image could be displayed without much color deviation similarly to the conventional image.

As described above, in the spacer manufacture method of the present embodiment, by utilizing the heat used in forming the glass material 102*a* to form the high resistance film 205 and the spacer electrodes 303, the heat utilization efficiency during the manufacture can be enhanced. Moreover, the tact time was reduced by the continuous process. As described above, in the present invention, the spacer remarkably high in mass productivity can be supplied.

Moreover, in the present example, the high resistance film and the spacer electrode were formed by utilizing the heat used in molding the substrate, but the heat can be utilized only during the drying. For example, when the solution with oxide particles dispersed therein is applied to form the high resistance film, in order to obtain the charging preventive function of the high resistance film, the crystal growth of oxide is necessary in some cases. In this case, after performing only the drying in a continuous process, the film can be formed by performing calcining separately. Also in this case, to continuously perform the drying process, the mass production efficiency can be raised.

Moreover, the present invention can be applied not only to the glass base material 101*a* having a rectangular section shape but also to the spacers having columnar, elliptical, square, and other shapes. Furthermore, in the present example, the high resistance film was formed in a single layer but may be formed in multiple layers. When the film is formed to be multilayered, the high resistance film can be formed by performing the spray application a plurality of times in accordance with the number of layers. Furthermore, the forming order of the high resistance film and spacer electrode can be reversed.

Additionally, in the present example, the spacer electrode is formed after the high resistance film is formed, but the high resistance film can be formed after the spacer electrode is formed.

Second Embodiment

Figure 10:
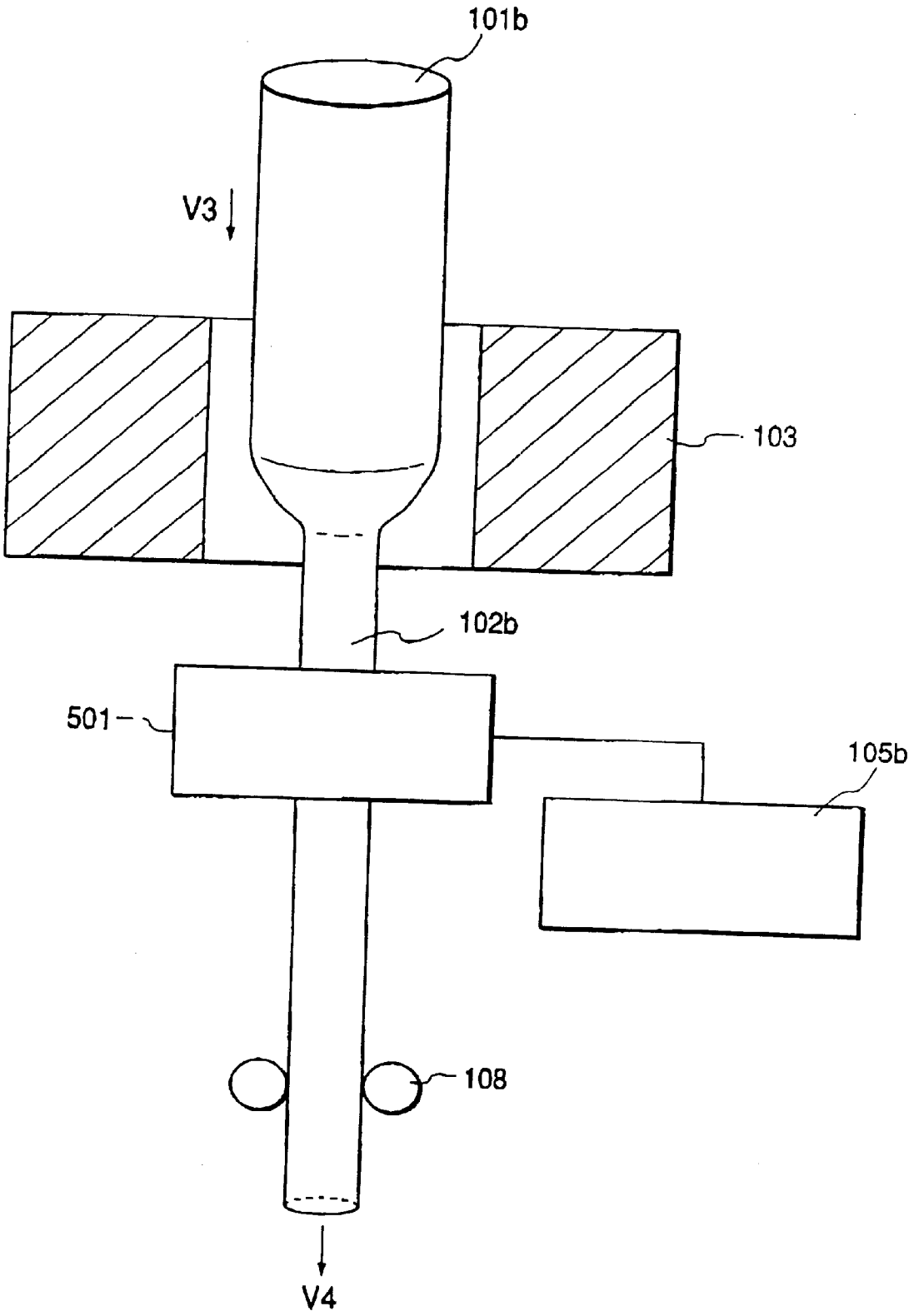
FIG. 10 is a diagram typically showing an apparatus used for a method of manufacturing a supporting member for an electron beam apparatus of a second embodiment according to the present invention.
Figure 11A:
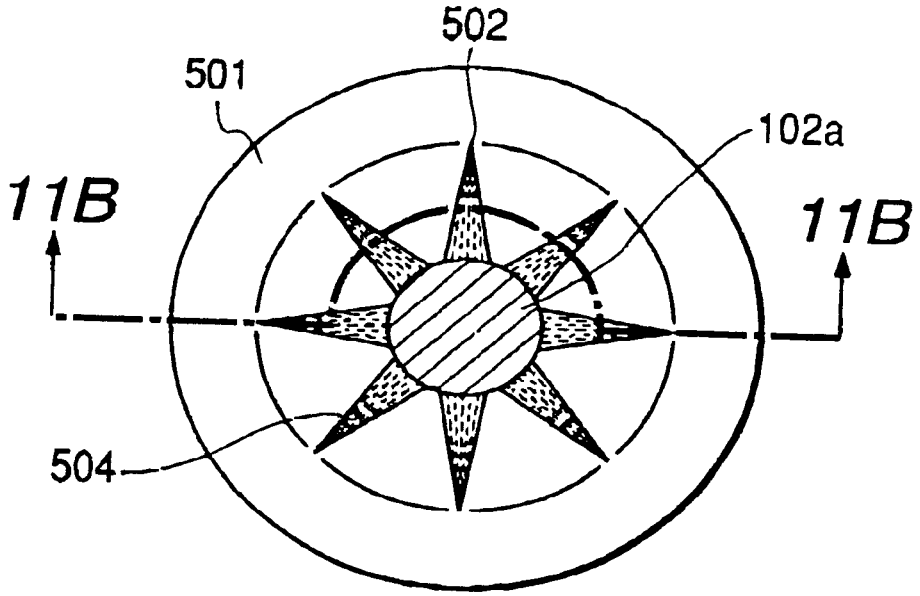
FIGS. 11A and 11B are diagrams of assistance in explaining a process of forming a high resistance film in a spray head portion shown in FIG. 10.
Figure 11B:
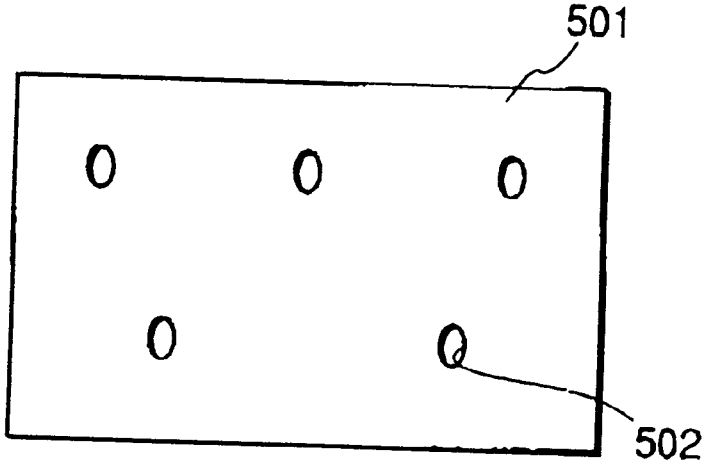

Referring to FIGS. 10, 11A and 11B, there are shown diagrams of assistance in explaining a method of manufacturing a supporting member for an electron beam apparatus according to a second embodiment of the present invention. FIG. 10 is a diagram typically showing an apparatus used for a method of manufacturing the supporting member for the electron beam apparatus of this embodiment, and FIGS. 11A and 11B are diagrams of assistance in explaining a step of forming a high resistance film in a spray head portion shown in FIG. 10. A method of manufacturing the supporting member for the electron beam apparatus of this embodiment is used for manufacturing the supporting member for the electron beam apparatus having a cylindrical shape by forming high resistance film and spacer electrodes on a cylindrical insulating member. In FIGS. 10, 11A and 11B, identical reference characters designate the same components used in the first embodiment.

In the method of manufacturing the supporting member for the electron beam apparatus of this embodiment, as shown in FIG. 10, a part of a glass base material 101*b* of the same component as for the insulating member forming the spacers as the supporting member for the electron beam apparatus is heated to a temperature equal to or higher than a softening point of the component of the glass base material 101*b* by using a thermal heater 103 to draw the heated portion of the glass base material 101*b* for molding. By this processing, a glass material 102*b* is made as a formation member for forming an insulating member, having the same sectional area as that of the insulating member composing the spacer. The glass material 101*b*, having a circular sectional configuration, extends unidirectionally like a stick with keeping the almost same sectional configuration and sectional area of the glass base material 101*b*.

In this embodiment, the glass material 102*b* is formed by heat and draw molding so as to have a cylindrical shape of 0.25 mm in diameter and a sectional area of the glass base material 101*b* is assumed to be 20 times the sectional area of the glass material 102*b*. A soda lime glass is used as a material of the glass base material 101*b* and a heating temperature of the glass base material 101*b* is assumed to be approx. 650° C. when the heater 103 is used. Furthermore, a pushing speed V3 of the glass base material 101*b* is assumed to be 5 m/min and a pull-out speed V4 of the glass material 102*b* is to be 100 m/min.

Next, a method of forming the high resistance film on the glass material 102*b* is described by referring to FIGS. 11A and 11B. FIG. 11A is a diagram showing a condition in which a coating solution is sprayed from a spray head 501, which is a plan view perpendicular to the direction of pushing the glass base material 101*b*. FIG. 11B is a section view of FIG. 11A taken on line 11B—11B, which is a diagram showing positions of spray holes on a spray head 501.

As shown in FIG. 11A, the spray head 501 has a cylindrical shape enclosing a part of the glass material 102*b* with a plurality of spray holes 502 for spraying the coating solution 504 formed on an inner surface of the spray head 501. In this embodiment, eight spray holes 502 are arranged inside the spray head 501 so that the coating solution 504 is sprayed from eight directions toward the glass material 102*b*. In addition, as shown in FIG. 11B, the eight spray holes 502 are arranged so as to be divided into two stages. The coating solution 504 is sprayed toward a surface of the glass material 102*b* from respective spray holes 502 arranged on the spray head 501 in this manner, by which the surface of the glass material 102*b* is uniformly coated with the coating solution 504. At this point, the coating solution 504 is sprayed from the spray holes 502 by means of nitrogen gas controlled by a controller 105*b* shown in FIG. 10. Afterwards the coating solution 504 applied on the surface of the glass material 102*b* is set up, by which a high resistance film is uniformly formed over the surface of the glass material 102*b*.

At this point, heat at forming the glass material 102*b* by heating the glass base material 101*b* for molding is utilized as heat for forming the high resistance film, and a part of the amount of the heat is supplemented with the heat used for heating the glass base material 101*b*. In this condition, a part of the heat used for heating the glass base material 101*b* is utilized as an amount of heat for drying the coating solution 504.

In this manner, the high resistance film on a side of the glass material 102*b* is formed in a process in which the glass material 102*b* cools down from a temperature at which the glass base material 101*b* is molded by heating the glass base material 101*b* to an atmospheric temperature around the glass material 102*b*. As for the coating solution 504, is used a coating solution in which NiO fine particles are dispersed to the solvent. Also in this embodiment, the pushing direction of the glass base material 101*b* and the pushing direction of the glass base material 101*b* and the pull-out direction of the glass material 102*b* are almost matched to a gravity direction.

Next, a formation in which the high resistance film is formed on the glass material 102*b* is cut perpendicularly to a longer direction of the glass material 102*b* so that the glass material 102*b* has a predetermined length. Accordingly, a cylindrical insulating member is made by using the cut portion of the glass material 102*b* as a component of the supporting member for the electron beam apparatus. Next, low resistance films are formed as spacer electrodes on the cut surface of the cylindrical glass material 102*b*, in other words, upper and lower surfaces of the cylindrical glass material 102*b* which has been cut, or the cut surface of the high resistance film formed on the side of the glass material 102*b*. Accordingly, spacers are manufactured as the supporting member for the electron beam apparatus in which the high resistance film and spacer electrodes are formed on the cut portions of the glass material 102*b* which is the cylindrical insulating material.

Figure 12:
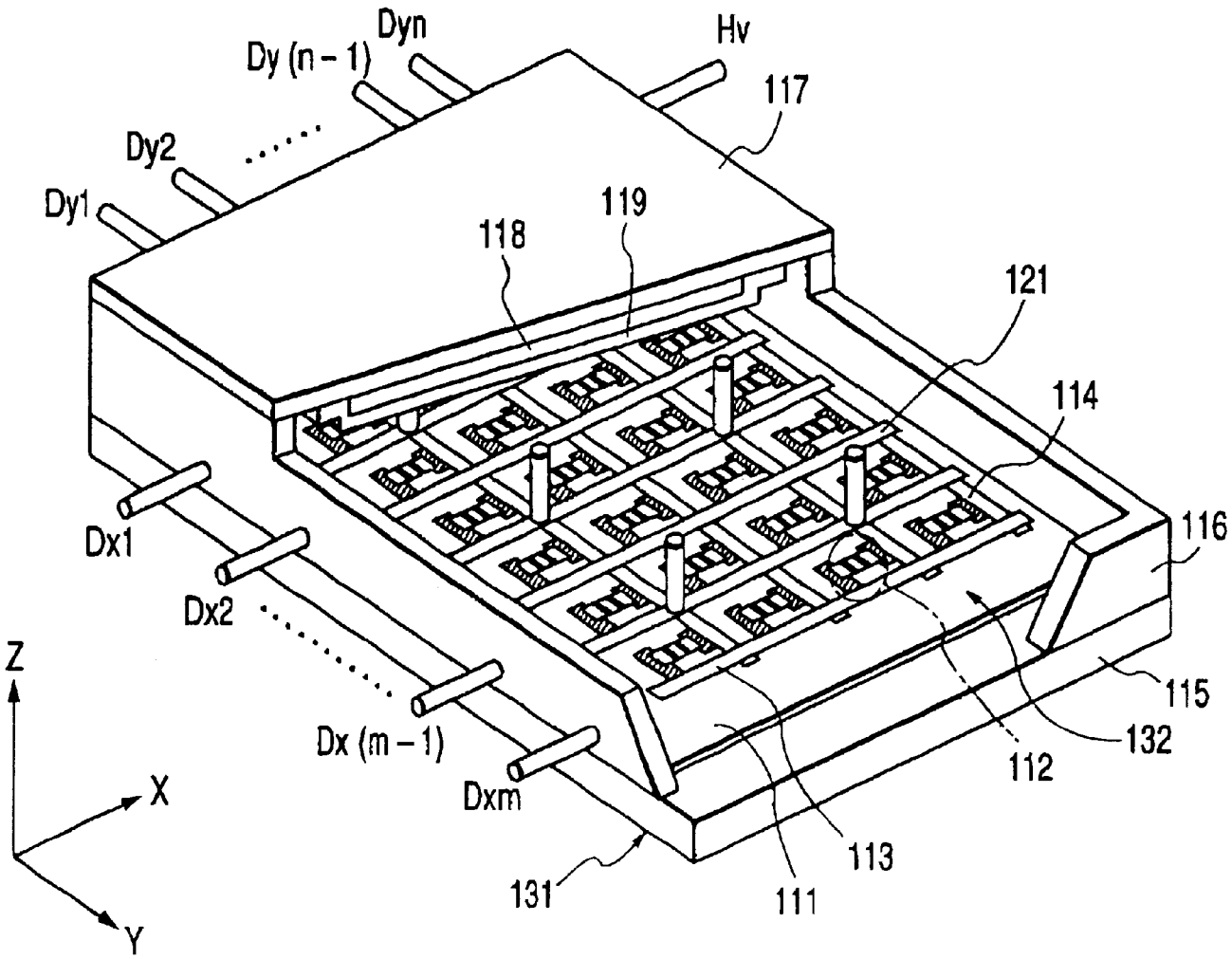
FIG. 12 is a perspective diagram of a display panel of an image display configured by using spacers according to the manufacturing method explained on the basis of FIGS. 10, 11A and 11B.

Referring to FIG. 12, there is shown a perspective view of a display panel of an image display configured by using the spacers according to the manufacturing method explained by referring to FIGS. 10, 11A and 11B. In FIG. 12, reference characters identical to those in FIG. 1 designate the same components as in FIG. 1. The display panel shown in FIG. 12 is different from that in FIG. 1 only in that spacers 121 are used instead of the spacers 120 in FIG. 1.

The spacer shown in FIG. 12 is a cylindrical supporting member for an electron beam apparatus manufactured by using a manufacturing method of this embodiment described by referring to FIGS. 10, 11A and 11B. Therefore, this type of a display panel of an image display also has achieved a capability of displaying a high-quality image with less color aberration in the same manner as for the conventional one.

Third Embodiment

Figure 13:
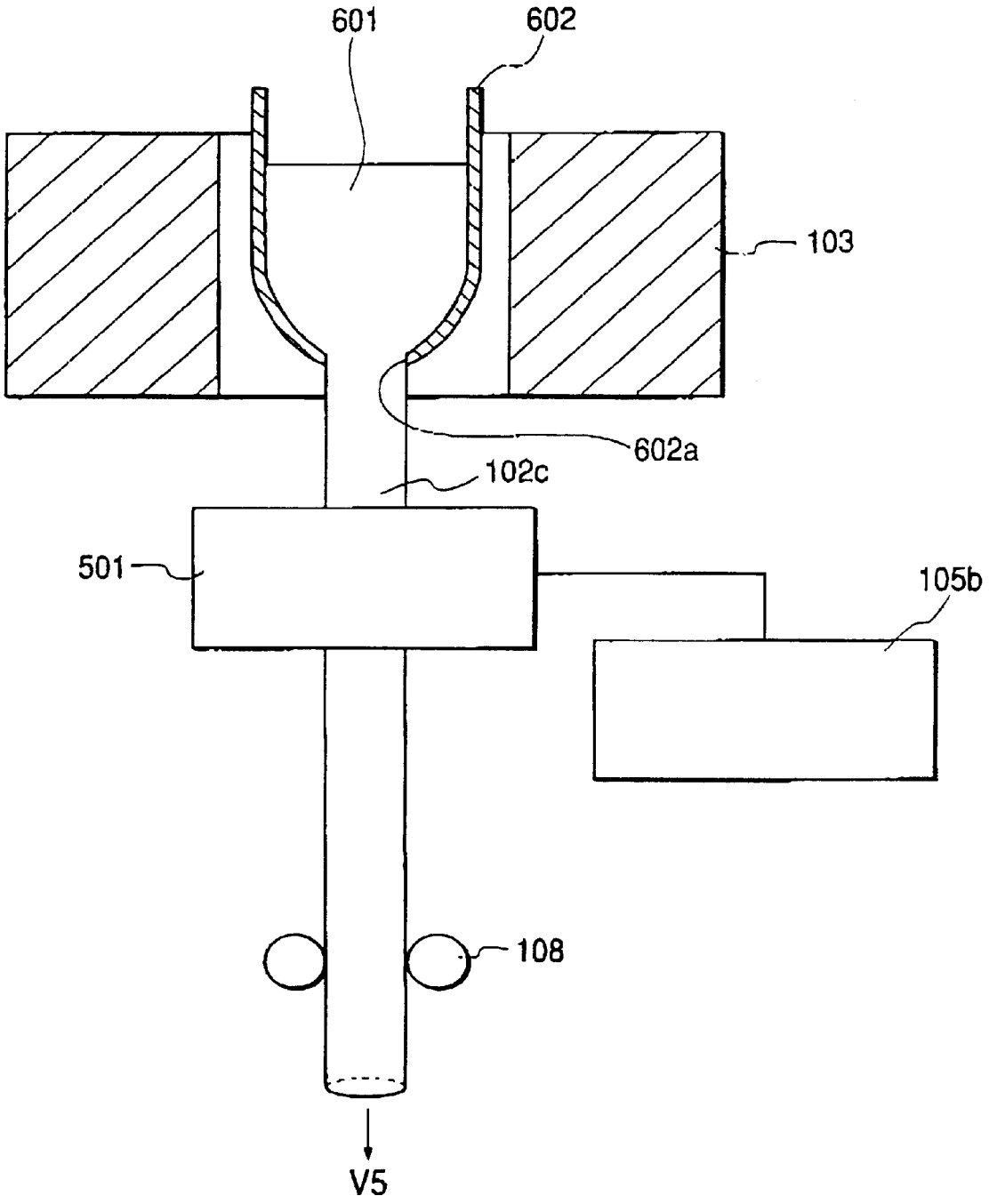
FIG. 13 is a diagram of assistance in explaining a method of manufacturing a supporting member for an electron beam apparatus of a third embodiment according to the present invention.

Referring to FIG. 13, there is shown a diagram of assistance in explaining a method of manufacturing a supporting member for an electron beam apparatus according to a third embodiment of the present invention. FIG. 13 typically shows an apparatus used for the method of manufacturing the supporting member for the electron beam apparatus of this embodiment. In FIG. 13, identical reference characters designate the same components used in the first and second embodiments.

In the method of manufacturing the supporting member for the electron beam apparatus of this embodiment, is used a melting pot 602 for melting a glass base material 601 as shown in FIG. 13. As a material of the glass base material 601, a soda lime glass is used. First, a glass base material 901 in the melting pot 602 is melted at a temperature of 950° C. by a heater 103. Although the heating temperature with the heater 103 can be equal to or higher than a softening point of the glass base material 601, the heating temperature is generally set within a range of 600° C. to 1,100° C. in the manufacturing method of this embodiment.

At a bottom of the melting pot 602, there is formed a hole 602*a* from which the glass base material 601 melted in the melting pot 602 flows outside the melting pot 602. The glass base material 601 flowing out of the hole 602*a* is set up, by which the set-up portion of the glass base material 601 becomes a glass material 102*c* which is a formation member for forming an insulating member which is a component of the supporting member for the electron beam apparatus. Therefore, the glass material 102*c* is formed by the set-up portion of the glass base material 601.

In this embodiment, an end portion of the glass material 102*c* opposite to the heater 103 is pulled out at the pull-out speed V5 by a pull-out roller 108. While the pull-out speed V5 of the glass material 102*c* is determined on the basis of a material type of the glass base material 601, a temperature of the glass base material 601, and a diameter of the hole 602*a* of the melting pot 602, an optimum condition of the pull-out speed V5 can be set arbitrarily. In this embodiment, the pull-out speed V5 is set to 50 m/min and a diameter of the hole 602*a* is set to 0.8 mm.

On a surface of the glass material 102*c* formed by the glass base material 601 melted in the melting pot 602 flowing out of the hole 602*a*, the high resistance film is formed by using the spray head 501 and the controller 105*b* used in the second embodiment. As for the coating solution sprayed from the spray head 501 for forming the high resistance film on the surface of the glass material 102*c*, is used a water solution to which fine particles of silicon and tin oxide are dispersed.

As set forth in the above, the high resistance film is formed on the side of the glass material 102*c* in a process in which the glass material 102*c* cools down from the temperature at which the glass base material 601 is heated to be melted for molding the glass base material 601 to an atmospheric temperature around the glass material 102*c*. Therefore, the heat at forming the glass material 102*c* by heating the glass base material 601 to be melted for molding the glass material 102*c* is utilized as a heat for forming the high resistance film on the glass material 102*c* and the amount of the heat is supplemented with the heat used for heating the glass base material 601 to be melted. In this embodiment, a measurement of 550° C. is obtained in relation to a surface temperature of a portion in the vicinity of the spray head 501 of the glass material 102*c* in a spraying stage with the spray head 501.

Subsequently, a formation in which the high resistance film is formed on the glass material 102*c* is cut perpendicularly to the longer direction of the glass material 102*c* so that the glass material 102*c* has a predetermined length. At this point, a cylindrical insulating member is made by using the cut portion as a component of the supporting member for the electron beam apparatus. Next, low resistance films are formed as spacer electrodes on the cut surface of the cylindrical glass material 102*c*, in other words, an upper surface and a lower surface of the cylindrical glass material 102*c* which has been cut, or the cut surface of the high resistance film formed on the side of the glass material 102*c*. Accordingly, spacers are manufactured as the supporting member for the electron beam apparatus in which the high resistance film and spacer electrodes are formed on the cut portions of the glass material 102*b* which is the cylindrical insulating material.

As a result of making the same display panel for the image display as shown in FIG. 12 according to the second embodiment by using the spacers manufactured as the supporting member for the electron beam apparatus according to a method of this embodiment, a high-quality image has been displayed with less color aberration in the same manner as for the conventional one.

Fourth Embodiment

Figure 14A:
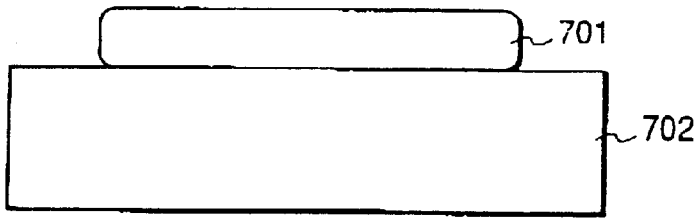
FIGS. 14A, 14B and 14C are diagrams of manufacturing a supporting member for an electron beam apparatus of a fourth embodiment according to the present invention.
Figure 14B:
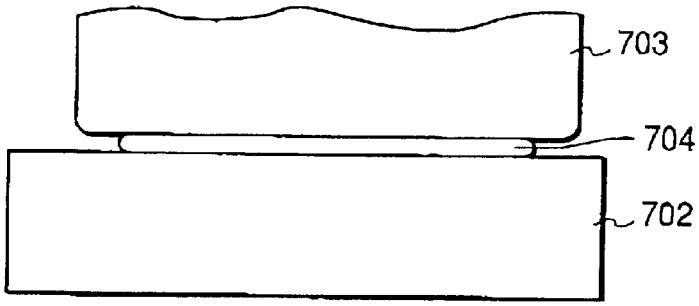
Figure 14C:
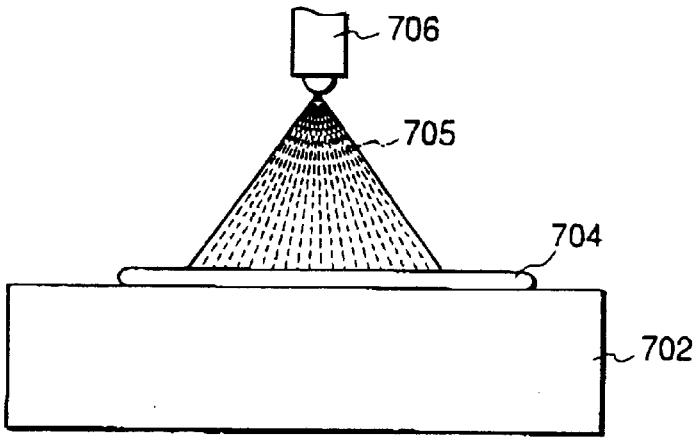
Figure 15:
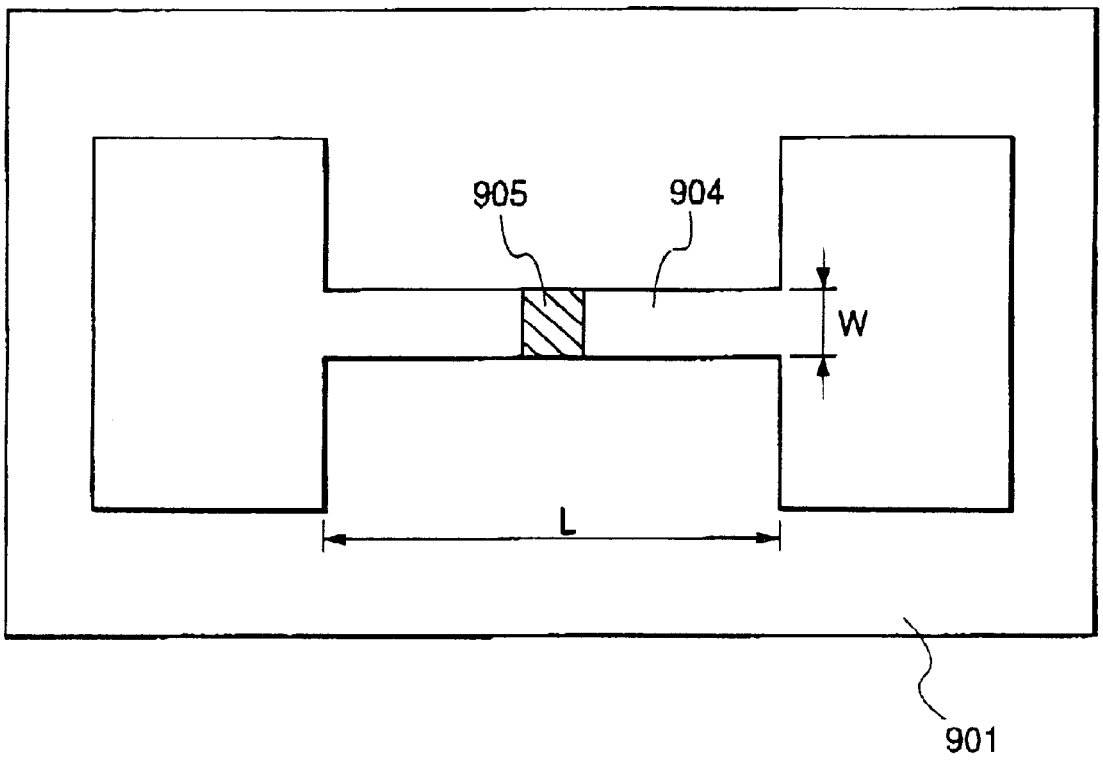
FIG. 15 is a plan view of a conventional surface conduction electron-emitting device.
Figure 16:
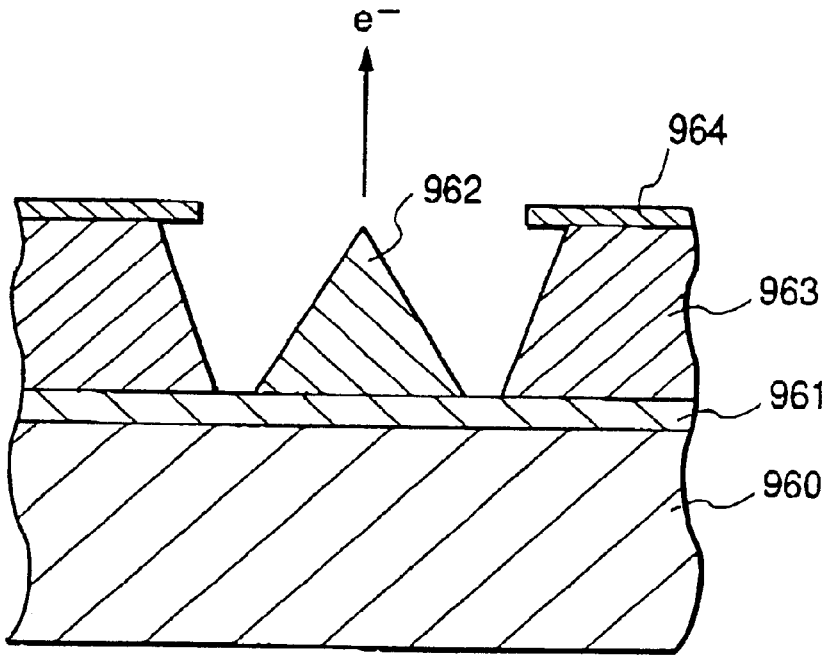
FIG. 16 is a cross-sectional view illustrating an example of a conventional FE device.
Figure 17:
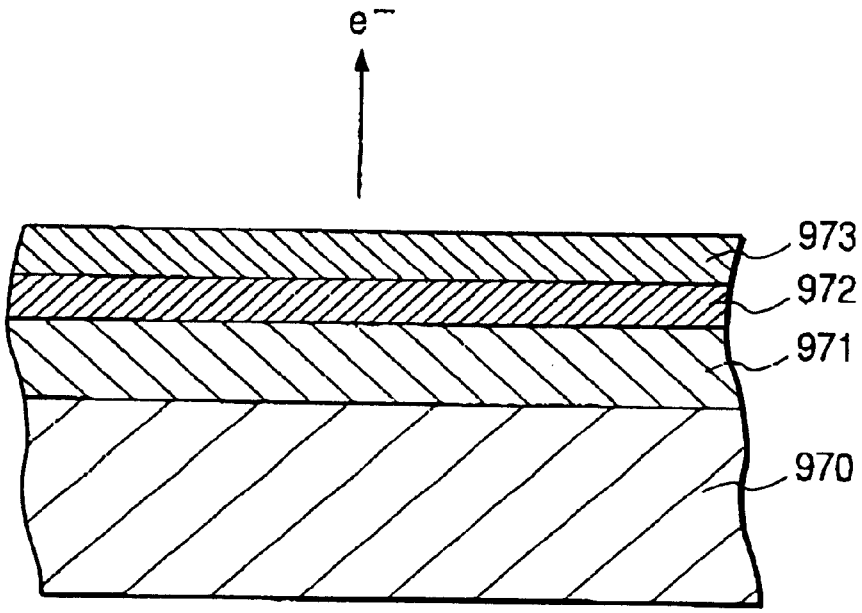
FIG. 17 is a cross-sectional view illustrating an example of a conventional MIN device.
Figure 18:
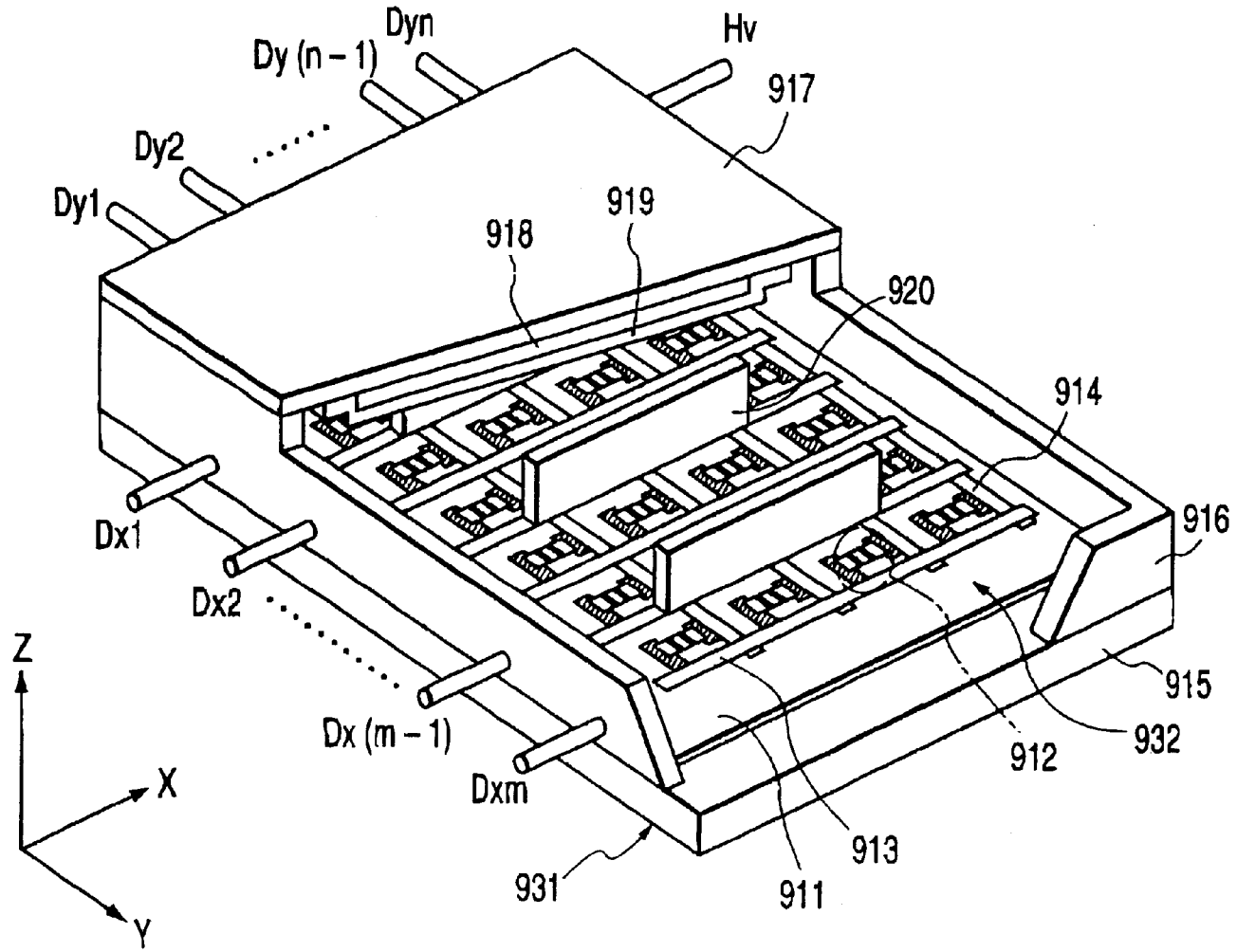
FIG. 18 is a perspective view illustrating an example of a display panel portion in a conventional flat panel display.
Figure 19:
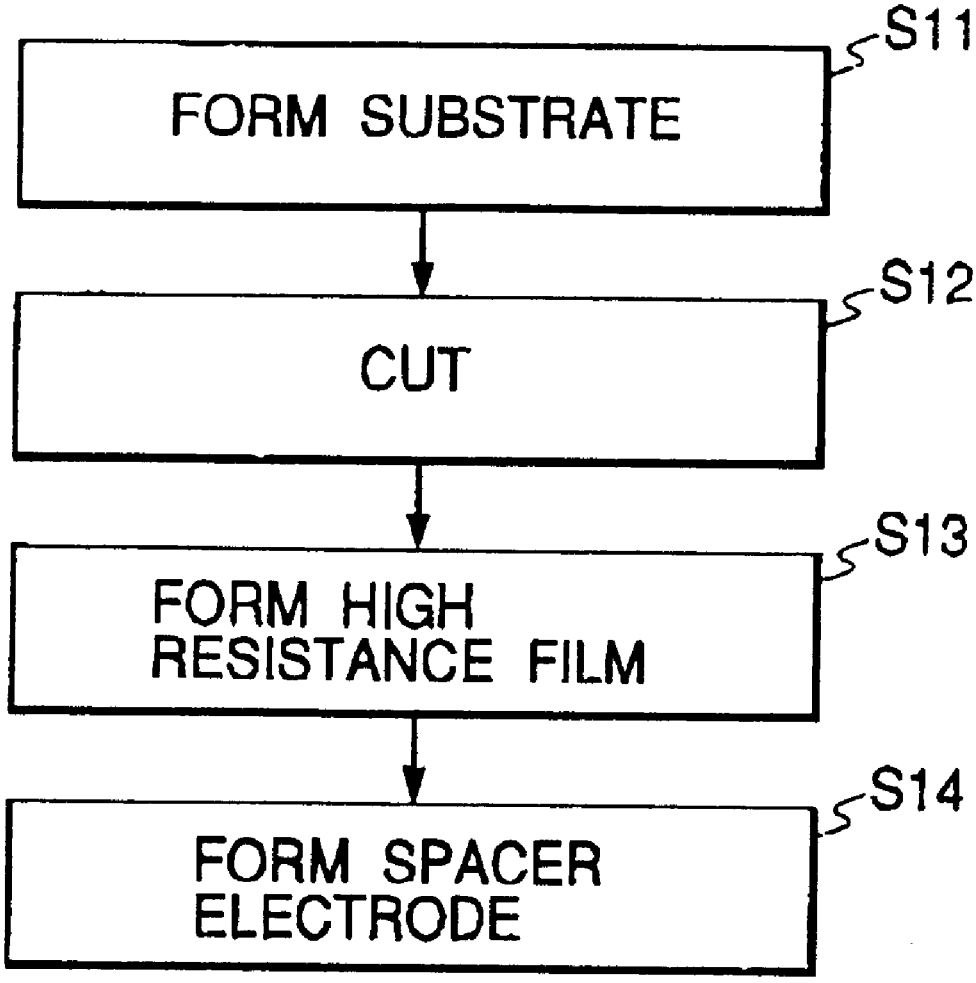
FIG. 19 is a flowchart of assistance in explaining a spacer manufacturing process according to a conventional technology.

Referring to FIGS. 14A to 14C, there are shown diagrams of assistance in explaining a method of manufacturing a supporting member for an electron beam apparatus according to a fourth embodiment of the present invention.

In the method of manufacturing the supporting member for the electron beam apparatus according to this embodiment, a plate glass base material 701 is mounted first on a surface of the heating plate 702 as shown in FIG. 14A. As a material of the glass base material 701, borosilicate glass is used. This glass base material 701 is heated to a temperature of 700° C. by a heating plate 702.

Next, the entire surface of the glass base material 701 heated on the heating plate 702 is pushed by a pressing member 703 to press the glass base material 701 as shown in FIG. 14B so that the glass base material 701 has a predetermined thickness. This forms a glass sheet 704 comprising the glass base material 701 shaped so as to have the predetermined thickness. In this manner, the glass base material 701 is compression molded by pressing it with the pressing member 703 so that the glass base material 701 has the predetermined thickness, by which the glass sheet 704 is made as a sheet formation member for forming an insulating member which is a component of a spacer as the supporting member for the electron beam apparatus.

Subsequently, as shown in FIG. 14C, a coating solution 705 is sprayed from a spray head 706 toward a surface of the glass sheet 704 to coat the entire surface of the glass sheet 704 uniformly with the coating solution 705. The coating solution 705 applied to the surface of the glass sheet 704 is set up in this condition, by which a precursor of a high resistance film is formed on the surface of the glass sheet 704.

Then, the glass sheet 704 covered by the precursor of the high resistance film on its surface is turned over so as to expose a rear surface of the glass sheet 704 and the rear surface is coated with the coating solution 705 in the same manner as for its face surface to form a precursor of the high resistance film.

As set forth in the above, the precursor of the high resistance film is formed on the face and rear surfaces of the glass sheet 704 in a process in which the glass sheet 704 cools down from the temperature at which the glass base material is heated to be compression molded to an atmospheric temperature around the glass sheet 704. Therefore, the heat at forming the glass sheet 704 by heating the glass base material 701 with the thermal heater 702 for compression molding the glass sheet 704 is utilized as a heat for forming the precursor of the high resistance film on the glass sheet 704, and the amount of the heat is supplemented with the heat used for heating the glass base material 701.

Subsequently by calcining a formation in which the precursor of the high resistance film is formed on the face and the rear surfaces of the glass sheet 704, the high resistance film is formed on the face and rear surfaces of the glass sheet 704.

In this embodiment, as the coating solution 705, is used a coating solution in which carboxylate of silicon and tin oxide is taken into solution at a density of carboxylate of 8 mol/l in octane solvent at 2:1 of a metal mixture molar ratio. The precursor of the high resistance film formed on the face and rear surfaces of the glass sheet 704 is carboxylic acid left on the glass sheet 704 being decomposed after the solvent has vapored from the coating solution 705 or adhering to the surface of the glass sheet 704 with a part of it not decomposed. In this embodiment, by calcining the coating solution 705 comprising the above component at 500° C., a stable high resistance film is formed on the surface of the glass sheet 704.

Next, a formation in which the high resistance film is formed on the face and rear surfaces of the glass sheet 704 is cut by using a dicing saw. At this point, an insulating member which is a component of the supporting member for the electron beam apparatus is made by using the cut portion of the glass sheet 704. Then, spacer electrodes are formed on a cut surface of the glass sheet 704 and a cut surface of the high resistance film on the glass sheet 704 for the cut portion of the glass sheet 704, by which spacers are manufactured as the supporting member for the electron beam apparatus in which the high resistance film and the spacer electrodes are formed on the insulating member.

As a result of making the same image display shown in FIG. 1 by using the spacers manufactured as the supporting member for the electron beam apparatus according to a method of this embodiment, a high-quality image has been displayed with less color aberration in the same manner as for the conventional one.

The method of manufacturing the supporting member for the electron beam apparatus according to the present invention is not limited to those in the first to fourth embodiments described above, but also includes combinations of the methods described in the first to fourth embodiments. For example, in the first to third embodiments, it is also possible to form the precursor of the high resistance film on the glass material by utilizing the heat for heating the glass base material for molding instead of forming the high resistance film directly on the glass material which is the formation member for forming the insulating member which is a component of the supporting member for the electron beam apparatus. In this case, by calcining the precursor of the high resistance film formed on the glass material, the high resistance film is formed on the glass material. In addition, in forming the spacer electrodes on the glass material, the precursor of the spacers electrodes can be formed on the glass material by utilizing the heat for heating the glass base material for molding. In this case, by calcining the precursor of the spacer electrodes formed on the glass material, the spacer electrodes can be formed on the glass material.

As set forth hereinabove, according to the present invention, it is possible to reduce a process time significantly for manufacturing a supporting member and to provide a supporting member with less unevenness of a shape and characteristics. In addition, the present invention has an effect that, in the cooling process of the formation member formed by heating and molding the base material comprising the component of the insulating member for manufacturing a supporting member for an electron beam apparatus being arranged in an airtight container for containing an electron source having a plurality of electron-emitting devices between the electron source and a control electrode and comprising an insulating member on which at least one of a high resistance film and an electrode is formed, it is possible to utilize the heat used when the base material is heated for molding to form the formation member with forming a high resistance film or the precursor on the formation member, for a purpose of forming the high resistance film or the electrode or their precursor, thereby improving an efficiency of utilization of the heat. Furthermore, the present invention advantageously reduces a time loss between a step of forming the formation member for forming the insulating member which is a component of the supporting member for the electron beam apparatus and a step of forming the high resistance film or the electrode on the formation member, thereby reducing a tact time, by which it is possible to achieve a method of manufacturing a supporting member for an electron beam apparatus having a high mass production property. Therefore, it has an effect that the supporting member for the electron beam apparatus can be manufactured in a small number of simplified sequential processes, thereby achieving a method of manufacturing a supporting member for an electron beam apparatus requiring only a short manufacturing time and a low manufacturing cost.

What is claimed is:

1. A method of manufacturing a supporting member for an electron beam apparatus comprising an airtight container, an electron source and said supporting member arranged in said airtight container, including a step of heating and drawing a substrate of said supporting member, wherein an electroconductive film is formed on a surface of said substrate in said heating and drawing step.

2. A method of manufacturing a supporting member for an electron beam apparatus according to claim 1, wherein said electroconductive film formation includes a step of coating said substrate with a solution including a component of said electroconductive film in said heating and drawing step.

3. A method of manufacturing a supporting member for an electron beam apparatus containing an electron source having a plurality of electron-emitting devices and a control electrode for controlling electrons emitted from said electron-emitting devices, being arranged between said electron source and said control electrode so as to support wall portions of an airtight container whose inside is kept in an almost vacuum, and comprising an insulating member on which at least one of a high resistance film and an electrode is formed, the manufacturing method comprising the steps of;

forming a formation member for forming said insulating member by molding with heating a base material comprising a component of said insulating member; and forming at least one of said high resistance film and said electrode or a precursor of at least one of said high resistance film and said electrode on said formation member in a process in which said formation member cools down from a temperature at which said base material is heated to be molded.

4. A method of manufacturing a supporting member for an electron beam apparatus according to claim 3, further comprising a step of manufacturing the supporting member for said electron beam apparatus in which at least one of said high resistance film and said electrode is formed on said insulating member comprising a cut portion of said formation member by cutting a formation in which at least one of said high resistance film and said electrode is formed on said formation member.

5. A method of manufacturing a supporting member for an electron beam apparatus according to claim 3, wherein said precursor is formed by coating said formation member with a solution in which at least one component of said high resistance film and said electrode is dispersed to a solvent and vaporizing said solvent by utilizing heat of said formation member so as to fix solute in said solution to said formation member when said precursor of at least one of said high resistance film and said electrode is formed on said formation member.

6. A method of manufacturing a supporting member for an electron beam apparatus according to claim 5, when said precursor of at least one of said high resistance film and said electrode is formed on said formation member, further comprising the steps of:

forming at least one of said high resistance film and said electrode on said formation member by calcining said precursor; and manufacturing the supporting member for said electron beam apparatus in which at least one of said high resistance film and said electrode is formed on said insulating member comprising a cut portion of said formation member by cutting a formation in which at least one of said high resistance film and said electrode is formed on said formation member.

7. A method of manufacturing a supporting member for an electron beam apparatus containing an electron source having a plurality of electron-emitting devices and a control electrode for controlling electrons emitted from said electron-emitting devices, being arranged between said electron source and said control electrode so as to support wall portions of an airtight container whose inside is kept in an almost vacuum, and comprising an insulating member on which at least one of a high resistance film and an electrode is formed, the manufacturing method comprising the steps of:

forming a formation member for forming said insulating member by molding with heating a base material comprising a component of said insulating member;

forming at least one of said high resistance film and said electrode on said formation member in a process in which said formation member cools down from a temperature at which said base material is heated to be molded;

forming the other among said high resistance film and said electrode on said formation member in a process in which said formation member cools down from a temperature at which one of said high resistance film and said electrode is formed on said formation member; and manufacturing the supporting member for the electron beam apparatus by cutting the formation in which said high resistance film and said electrode are formed on said formation member.

8. A method of manufacturing a supporting member for an electron beam apparatus containing an electron source having a plurality of electron-emitting devices and a control electrode for controlling electrons emitted from said electron-emitting devices, being arranged between said electron source and said control electrode so as to support wall portions of an airtight container whose inside is kept in an almost vacuum, and comprising an insulating member on which at least one of a high resistance film and an electrode is formed, the manufacturing method comprising the steps of:

forming a cylindrical formation member for forming said insulating member by molding with heating a base material comprising a component of said insulating member; forming said high resistance film on sidewalls of said formation member in a process in which said formation member cools down from a temperature at which said base material is heated to be molded;

cutting the formation in which said high resistance film is formed on said formation member at a predetermined length to make said high resistance film formed on said insulating member; and forming said electrode on a cut surface of said insulating member and of said high resistance film.

9. A method of manufacturing a supporting member for an electron beam apparatus according to claim 7 or claim 8, wherein said step of forming said formation member for forming said insulating member of said electron beam apparatus supporting member comprises the steps of:

preparing said stick base material comprising a component of said insulating member and extending unidirectionally having a sectional configuration similar to that of said formation member and a sectional area larger than that of said formation member; and heating a part of said base material in a longer direction to a temperature equal to or higher than a softening point of said base material with both ends of said base material supported and elongating said base material by pushing one end of said base material toward said part in the longer direction and by pulling the other end in the same direction as said direction of pushing said one end so as to form said formation member comprising said elongated portion of said base material.

10. A method of manufacturing a supporting member for an electron beam apparatus according to claim 8, wherein said step of forming said cylindrical formation member for forming said insulating member of said electron beam apparatus supporting member comprises forming said cylindrical formation member comprising a set-up portion of said base material by heating and melting said base material comprising the component of said insulating member inside a melting pot having a hole at its bottom and by setting up said base material flowing out of said hole of said melting pot.

11. A method of manufacturing a supporting member for an electron beam apparatus containing an electron source having a plurality of electron-emitting devices and a control electrode for controlling electrons emitted from said electron-emitting devices, being arranged between said electron source and said control electrode so as to support wall portions of an airtight container whose inside is kept in an almost vacuum, and comprising an insulating member on which at least one of a high resistance film and an electrode is formed, the manufacturing method comprising the steps of:

heating a base material comprising a component of said insulating member;

forming a sheet formation member for forming said insulating member by pushing said heated base material for compression so that said base material has a predetermined thickness;

forming a precursor of said high resistance film on face and rear surfaces of said sheet formation member in a process in which said sheet formation member cools down from a temperature at which said base material is compressed;

forming said high resistance film on the face and rear surfaces of said sheet formation member by calcining said precursor of said high resistance film formed on said face and rear surfaces of said sheet formation member; cutting the formation in which said high resistance film is formed on said sheet formation member to make said high resistance film formed on said insulating member comprising a cut portion of said sheet formation member; and forming said electrode on a cut surface of said insulating member and of said high resistance film.

12. A method of manufacturing a supporting member for an electron beam apparatus according to claim 11, wherein said precursor is formed by coating said sheet formation member with a solution in which a component of said high resistance film is dispersed to a solvent and vaporizing said solvent by utilizing heat of said sheet formation member so as to fix solute in said solution to said sheet formation member when said precursor of said high resistance film is formed on said sheet formation member.

13. A method of manufacturing a supporting member for an electron beam apparatus according to one of claims 3 to 8 and 10 to 12, wherein said formation member is coated with said solution by spraying said solution including the component of said high resistance film on said formation member when said high resistance film or said precursor of said high resistance film is formed on said formation member.

14. A method of manufacturing a supporting member for an electron beam apparatus according to claim 13, wherein a plurality of injecting portions for spraying said solution are used when said solution including the component of said high resistance film is sprayed on said formation member.

15. A method of manufacturing a supporting member for an electron beam apparatus according to one of claims 3 to 8 and 10 to 12, wherein said formation member is coated with a solution including a component of said electrode by using a transfer roller when said electrode or the precursor of said electrode is formed on said formation member.

16. A method of manufacturing an image displaying apparatus comprising an airtight container, and a supporting member arranged in said airtight container, wherein said supporting member is produced by a step of heating and drawing a substrate of said supporting member, wherein an electroconductive film is formed on a surface of said substrate in said heating and drawing step.

17. A method of manufacturing an image displaying apparatus comprising an airtight container, and a supporting member arranged in said airtight container, wherein said supporting member is produced by a step of heating and drawing a substrate of said supporting member, wherein a material providing said supporting member with electroconductivity is applied on a surface of said substrate in said heating and drawing step.

18. A method according to claim 17, wherein said material is a liquid containing metal.

19. A method of manufacturing an image displaying apparatus comprising an airtight container, and a supporting member arranged in said airtight container, wherein said supporting member is produced by a step of heating and drawing a substrate of said supporting member; and a step of forming an electroconductive film on a surface of said substrate during a process of cooling said substrate from the heating.

20. A method of manufacturing an image displaying apparatus comprising an airtight container, and a supporting member arranged in said airtight container, wherein said supporting member is produced by a step of heating and drawing a substrate of said supporting member; and a step of applying a material providing said supporting member with an electroconductivity to a surface of the substrate during a process of cooling said substrate from the heating.

21. A method according to claim 20, wherein said material is a liquid containing metal.

22. A method of manufacturing an image displaying apparatus comprising an airtight container, and a supporting member arranged in said airtight container, wherein said supporting member is produced by a step of forming a substrate of said supporting member by heating, wherein an electroconductive film is formed on a surface of said substrate in said forming step.

23. A method of manufacturing an image displaying apparatus comprising an airtight container, and a supporting member arranged in said airtight container, wherein said supporting member is produced by a step of forming a substrate of said supporting member, wherein a material providing said supporting member with electroconductivity is applied on a surface of said substrate in said forming step.

24. A method according to claim 23 wherein said material is a liquid containing metal.

25. A method of manufacturing an image displaying apparatus comprising an airtight container, and a supporting member arranged in said airtight container, wherein said supporting member is produced by a step of forming a substrate of said supporting member by heating; and a step of forming an electroconductive film on a surface of said substrate during a process of cooling said substrate from the heating.

26. A method of manufacturing an image displaying apparatus comprising an airtight container, and a supporting member arranged in said airtight container, wherein said supporting member is produced by a step of forming a substrate of said supporting member by heating; and a step of applying a material providing said supporting member with an electric conductivity to a surface of said substrate.

27. A method according to claim 26, wherein said material is a liquid containing metal.

28. A method according to any one of claims 16–27, wherein said image displaying apparatus further comprises an electron source and a phosphor within said airtight container.

* * * * *

UNITED STATES PATENT AND TRADEMARK OFFICE

CERTIFICATE OF CORRECTION

PATENT NO. : 6,485,345 B1
DATED : November 26, 2002
INVENTOR(S) : Masahiro Fushimi It is certified that error appears in the above-identified patent and that said Letters Patent is hereby corrected as shown below:

Column 19,
Line 48, "subsequently," should read -- Subsequently, --.

Column 34,
Line 44, "claim 23" should read -- claim 23, --.

Signed and Sealed this

First Day of July, 2003

JAMES E. ROGAN
*Director of the United States Patent and Trademark Office*